US009841694B2

(12) United States Patent
Uchino et al.

(10) Patent No.: US 9,841,694 B2
(45) Date of Patent: Dec. 12, 2017

(54) IMAGE FORMING METHOD, ELECTROSTATIC CHARGE IMAGE DEVELOPER SET, AND IMAGE FORMING APPARATUS

(71) Applicant: Konica Minolta, Inc., Tokyo (JP)

(72) Inventors: Yasuko Uchino, Hino (JP); Junya Onishi, Hachioji (JP); Natsuko Fujisaki, Hino (JP); Anju Hori, Hachioji (JP); Junya Ueda, Hino (JP); Takaki Kawamura, Hino (JP); Ikuko Sakurada, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/063,930

(22) Filed: Mar. 8, 2016

(65) Prior Publication Data

US 2016/0282741 A1 Sep. 29, 2016

(30) Foreign Application Priority Data

Mar. 25, 2015 (JP) ..... 2015-062799

(51) Int. Cl.

| | |
|---|---|
| ***G03G 9/10*** | (2006.01) |
| ***G03G 13/01*** | (2006.01) |
| ***G03G 9/08*** | (2006.01) |
| ***G03G 9/113*** | (2006.01) |
| ***G03G 15/09*** | (2006.01) |
| ***G03G 15/00*** | (2006.01) |

(52) U.S. Cl.

CPC ..... *G03G 9/10* (2013.01); *G03G 9/0823* (2013.01); *G03G 9/1133* (2013.01); *G03G 9/1139* (2013.01); *G03G 13/013* (2013.01); *G03G 15/09* (2013.01); *G03G 15/6585* (2013.01); *G03G 2215/0135* (2013.01); *G03G 2215/0607* (2013.01); *G03G 2215/0609* (2013.01)

(58) Field of Classification Search

CPC ..... G03G 13/013; G03G 13/01; G03G 9/10; G03G 9/1133; G03G 9/1139

USPC ..... 430/107.1, 45.56, 45.1, 45.32, 111.35, 430/111.32

See application file for complete search history.

(56) References Cited

U.S. PATENT DOCUMENTS

| | | | | |
|---|---|---|---|---|
| 4,943,506 | A | 7/1990 | Demizu et al. | |
| 5,258,253 | A | 11/1993 | Fukumoto et al. | |
| 6,114,077 | A | 9/2000 | Voets et al. | |
| 7,729,650 | B2 * | 6/2010 | Tamaki ..... | G03G 15/161 399/299 |
| 2005/0201779 | A1 | 9/2005 | Katayanagi | |
| 2012/0237868 | A1 | 9/2012 | Yamada et al. | |

FOREIGN PATENT DOCUMENTS

| | | | |
|---|---|---|---|
| EP | 0422892 | A2 | 4/1991 |
| JP | H01-105962 | A | 4/1989 |
| JP | H03-200978 | A | 9/1991 |
| JP | 2000056514 | A | 2/2000 |
| JP | 2004037565 | A | 2/2004 |
| JP | 2006220694 | A | 8/2006 |
| JP | 3960318 | B2 | 5/2007 |
| JP | 2012189929 | A | 10/2012 |

* cited by examiner

*Primary Examiner* — Janis L Dote
(74) *Attorney, Agent, or Firm* — Lucas & Mercanti, LLP

(57) ABSTRACT

An image forming method forms a color toner image and a white toner image using an image forming apparatus having a plurality of developing machines. The color toner image is formed using a color developer containing a first carrier and at least one color toner selected from a yellow toner, a magenta toner, and a cyan toner. The white toner image is formed using a white developer containing a second carrier and a white toner containing at least titanium oxide as a pigment. Formula (1):

$$Iw<Ic \quad (1)$$

is satisfied. Ic (μA) is a dynamic current value of the first carrier at 100 V and Iw (μA) is a dynamic current value of the second carrier at 100 V.

10 Claims, 2 Drawing Sheets

IMAGE FORMING METHOD, ELECTROSTATIC CHARGE IMAGE DEVELOPER SET, AND IMAGE FORMING APPARATUS

CROSS-REFERENCE TO RELATED APPLICATION

This application is based on Japanese Patent Application No. 2015-062799 filed on Mar. 25, 2015, the contents of which are incorporated herein by reference.

BACKGROUND

1. Technical Field

The present invention relates to an image forming method, an electrostatic charge image developer set, and an image forming apparatus.

2. Description of Related Arts

In an electrographic image forming method, charging is performed uniformly on an image forming body by a charging means, and then image exposure is performed to form an electrostatic charge image. A latent image portion is developed by a succeeding developing means to form a toner image. Recently, in a field of a toner for an electrostatic charge image development used for electrographic image forming, a development according to various requirements from the market has been performed. Particularly, the kind of a recording medium to be printed is increasing. Correspondence of a printing machine to the recording medium is required very highly by the market. For example, when outputting is performed to a special recording medium such as colored paper, black paper, aluminum deposited paper, or a transparent film, a color cannot be sufficiently developed only with a full color toner such as a yellow, magenta, cyan, or black toner due to an influence by color characteristics of a recording medium. Therefore, in order to improve an additional value of an image, a white toner formed in a lower layer or an upper layer of an image formed in combination of the above color toners has been developed (for example, refer to JP 2004-037565 A, JP 3960318 B1 (corresponding to US 2005/201779 A), JP 2012-189929 A, and JP 2006-220694 A).

Particularly, when a transparent film is used as a medium (recording medium), by forming an image on a white toner image with a color toner, visibility of the color toner is improved, and an additional value of an image can be improved. By forming a white toner image on colored paper, it is possible to express "white" which is not easily expressed with a color toner. In order to perform this, it is important to increase a contrast ratio of a white toner and to further improve a degree of whiteness. Various technologies have been developed (for example, refer to JP 1-105962 A and JP 2000-56514 A).

JP 3-200978 A (corresponding to EP 0422892 A) discloses a carrier for a white toner, coated with an amino-containing silicon resin.

SUMMARY

However, it has been found that when a color toner image and a white toner image are formed on a recording medium using the technologies described in the above patent literatures, image unevenness occurs disadvantageously.

Therefore, the present invention has been achieved in view of the above-described circumstances. An object of the present invention is to provide an image forming method, an electrostatic charge image developer set, and an image forming apparatus, capable of suppressing image unevenness of a color toner image and a white toner image on a recording medium.

The present inventors have made intensive studies in order to solve the above-described problems. As a result, the present inventors have found that the above-described problems are solved by the following image forming method and have completed the present invention. That is, in the image forming method, a color toner image and a white toner image are formed using an image forming apparatus having a plurality of developing machines, and $Iw<Ic$ is satisfied wherein Ic (μA) is a dynamic current value of a first carrier contained in a color developer used for forming a color toner image at 100 V and Iw (μA) is a dynamic current value of a second carrier contained in a white developer used for forming a white toner image at 100 V.

DETAILED DESCRIPTION

Figure 1:
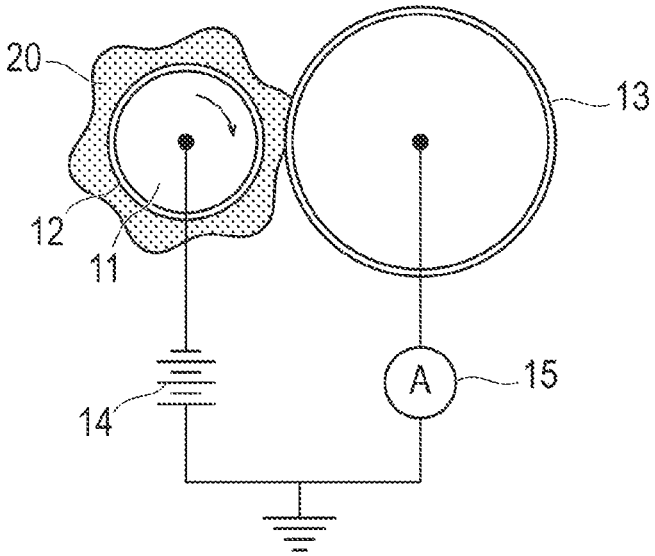
FIG. 1 is a schematic view illustrating an example of a measuring apparatus of a dynamic current value of a carrier; reference sign 11 represents aluminum electrode drum, reference sign 12 represents developing sleeve, reference sign 13 represents electrode drum, reference sign 14 represents direct current power source, reference sign 15 represents ammeter, and reference sign 20 represents carrier.

Hereinafter, embodiments of the present invention will be described. The present invention is not limited only to the following embodiments.

Here, "from X to Y" indicating a range means "X or more and Y or less". Unless otherwise specified, an operation and a measurement of physical properties or the like are performed under conditions of room temperature (20 to 25° C.)/relative humidity of 40 to 50% RH.

The above-described object is achieved by at least any one of the following means.

The first embodiment of the present invention is an image forming method of forming a color toner image and a white toner image using an image forming apparatus having a plurality of developing machines, in which the color toner image is formed using a color developer containing at least one color toner selected from the group consisting of a yellow toner, a magenta toner, and a cyan toner and a first carrier, the white toner image is formed using a white developer containing a white toner containing at least titanium oxide as a pigment and a second carrier, and the following formula (1) is satisfied wherein Ic (μA) is a dynamic current value of the first carrier at 100 V and Iw (μA) is a dynamic current value of the second carrier at 100 V.

[Numerical formula 1]

$$Iw<Ic \quad (1)$$

The second embodiment of the present invention is an electrostatic charge image developer set including a color developer containing at least one kind of color toner selected from the group consisting of a yellow toner, a magenta toner, and a cyan toner and a first carrier, and a white developer containing a white toner containing at least titanium oxide as a pigment and a second carrier, in which the above formula (1) is satisfied when a dynamic current value of the first carrier at 100 V is Ic (μA) and a dynamic current value of the second carrier at 100 V is Iw (μA).

The third embodiment of the present invention is an image forming apparatus including the above electrostatic charge image developer set and a plurality of developing machines.

According to the above-described embodiments, an image forming method, an electrostatic charge image developer set, and an image forming apparatus, capable of suppressing image unevenness of a color toner image and a white toner image on a recording medium, are provided.

The present inventors have made intensive studies in order to solve the above-described problems in the prior art. As a result, the present inventors have found the following technical knowledge (or a logic of the invention (logic: mechanism or working mechanism to combine a problem to an effect)) and have reached the above-described components of the embodiments based on the knowledge.

A white toner containing at least titanium oxide as a pigment has a smaller charged amount than a color toner. Therefore, when a carrier of a color developer containing a color toner is the same as a carrier of a white developer containing a white toner, a transfer efficiency of the color toner is different from that of the white toner. Transfer unevenness of the color toner and the white toner occurs onto a recording medium. Therefore, there is a problem in that image unevenness of a color toner image and a white toner image occurs on a recording medium after fixation.

With regard to such a problem, the present inventors have found the following. That is, by making the dynamic current value Iw (μA) of a carrier contained in a white developer at 100 V smaller than the dynamic current value Ic (μA) of a carrier contained in a color developer at 100 V (in other words, by making a resistance of the carrier contained in the white developer higher), the charged amount of the color toner can be almost the same as that of the white toner, the transfer efficiency of the color toner onto a recording medium can be the same as that of the white toner, and transfer unevenness is suppressed. The present inventors have found that image unevenness of a color toner image and a white toner image on a recording medium can be thereby suppressed, and have completed the present invention (above-described embodiments).

Hereinafter, an embodiment of the present invention will be described in detail.

[Image Forming Method]

In an image forming method according to an embodiment of the present invention, a color toner image and a white toner image are formed using an image forming apparatus having a plurality of developing machines. The image forming method is characterized in that the color toner image is formed using a color developer containing at least one color toner selected from the group consisting of a yellow toner, a magenta toner, and a cyan toner and a first carrier, the white toner image is formed using a white developer containing a white toner containing at least titanium oxide as a pigment and a second carrier, and the following formula (1) is satisfied wherein Ic (μA) is a dynamic current value of the first carrier at 100 V and Iw (μA) is a dynamic current value of the second carrier at 100 V.

[Numerical formula 2]

$$Iw<Ic \quad (1)$$

In the image forming method according to an aspect of the present invention, an image forming layer A obtained by using a color toner and an image forming layer B adjacent to the image forming layer A, obtained by using a white toner, are fixed on a medium (recording medium) to form an image. In this case, there are three methods as described below. In the first method, an image forming layer B obtained by transferring a white toner onto a recording medium is fixed, and then an image forming layer A obtained by transferring a color toner onto a recording medium is fixed (a color toner image is formed in an upper layer of a white toner image). In the second method, an image forming layer A obtained by transferring a color toner onto a recording medium is fixed, and then an image forming layer B obtained by transferring a white toner onto a recording medium is fixed (a white toner image is formed in an upper layer of a color toner image). In the third method, an image forming layer A obtained by transferring a color toner onto a recording medium and an image forming layer B obtained by transferring a white toner onto a recording medium are fixed simultaneously (a white toner image is formed in an upper layer or a lower layer of a color toner image). However, it is preferable to form an image by fixing an image forming layer A and an image forming layer B simultaneously because an effect of the present invention is more obtained and an image forming rate is high.

Preferably, first, an electrostatic latent image electrostatically formed on an image carrier is revealed by a developer in a developing machine (developing apparatus) to obtain a toner image (image forming layer). Subsequently, this toner image is transferred onto a recording medium, and then the toner image transferred onto the recording medium is fixed to a recording material by a contact heating type fixing treatment. A visible image is thereby obtained. In this case, it is preferable to include a means for transferring a toner image onto a recording medium via an intermediate transfer body.

Examples of a preferable fixing method include a so-called contact heating type fixing method. Examples of the contact heating type include particularly a heat pressure fixing type, a heat roll fixing type, and a pressure contact heating fixing type. In the pressure contact heating fixing type, a toner image is fixed with a rotating pressurized member including a fixed heating body.

In the heat roll fixing type fixing method, usually, a fixing apparatus including an upper roller and a lower roller is used. The upper roller includes a heat source in a metal cylinder made of iron, aluminum, or the like and having a surface coated with a fluorocarbon resin or the like. The lower roller is made of a silicone rubber or the like.

As the heat source, a linear heater is used. The surface of the upper roller is heated to a temperature of about 120 to 200° C. with this heater. A pressure is applied between the upper roller and the lower roller. The lower roller is deformed by this pressure. A so-called nip is thereby formed in this deformed part. The width of the nip is from 1 to 10 mm, and preferably from 1.5 to 7 mm. The fixing linear velocity is preferably from 40 mm/sec to 600 mm/sec.

<Recording Medium>

A generally used recording medium (also referred to as a medium, a recording material, recording paper, a recording sheet, or the like) may be used. As long as the recording medium holds a toner image, the recording medium is not particularly limited. Specific examples thereof include regular paper from thin paper to thick paper, high quality paper, coated paper for printing such as art paper or coat paper, commercially available Japanese paper or postcard paper, an OHP plastic film, cloth, a soft transparent film, and synthetic paper such as Yupo paper. In the image forming method according to an aspect of the present invention, particularly in a case of outputting to a special recording medium such as colored paper, black paper, aluminum deposited paper, or a transparent film, occurrence of image unevenness can be suppressed and a high quality image can be formed even when a white toner image is formed in an upper layer or a lower layer of a color toner image. In this point, the image forming method is excellent.

Next, a color developer and a white developer used in the image forming method according to an aspect of the present invention will be described in detail.

[Color Developer and White Developer]

The color developer according to an aspect of the present invention contains at least one color toner selected from the group consisting of a yellow toner, a magenta toner, and a cyan toner and a first carrier. The white developer according to an aspect of the present invention contains a white toner containing at least titanium oxide as a pigment and a second carrier. Hereinafter, a first carrier and a second carrier according to an aspect of the present invention will be also simply referred to as a "carrier" collectively.

[Carrier]

<Core Particle>

Examples of a material of a core particle of the carrier (the first carrier and the second carrier) according to an aspect of the present invention include iron powder, magnetite, various ferrite particles, and a resin in which these particles are dispersed. Magnetite and various ferrite particles are preferable. Preferable examples of the ferrite include a ferrite containing a heavy metal such as copper, zinc, nickel, or manganese, and a ferrite containing a heavy metal and an alkali metal and/or a group 2 metal such as magnesium. A commercially available core particle or a synthetic core particle can be used.

The volume average particle diameter of a core particle (median diameter based on volume) is preferably from 10 to 100 μm, and more preferably from 20 to 80 μm. A core particle having a volume average particle diameter within this range is suitable for obtaining a printed matter having a high resolution.

As for a magnetization characteristic of a core particle itself, the saturation magnetization is preferably from 30 to 80 $A \cdot m^2/kg$. By using a core particle having such a magnetization characteristic, carrier particles are prevented from being agglomerated partially, a two-component developer is dispersed uniformly on a surface of a conveying member of the two-component developer, and a uniform and fine toner image can be formed.

For example, the volume average particle diameter of a core particle can be measured by a laser diffraction particle size distribution measuring apparatus including a wet type dispersing machine "HELOS" (manufactured by Sympatec GmbH). For example, the saturation magnetization of a core particle is a value measured by a "direct current magnetization characteristic automatic recorder 3257-35" (manufactured by Yokogawa Electric Corporation).

<Coating Resin>

The carrier according to an aspect of the present invention is preferably a resin coated carrier in which the above-described core particle is coated with a resin. Examples of the resin to form a resin coating layer include a polyolefin-based resin such as polyethylene, polypropylene, chlorinated polyethylene, or chlorosulfonated polyethylene; a polystyrene resin; a (meth)acrylic resin such as polymethyl methacrylate; a polyvinyl resin and a polyvinylidene resin such as polyacrylonitrile, polyvinyl acetate, polyvinyl alcohol, polyvinyl butylal, polyvinyl chloride, polyvinyl carbazole, polyvinyl ether, or polyvinyl ketone; a copolymer resin such as a vinly chloride-vinyl acetate copolymer or a styrene-acrylic acid copolymer; a silicone resin formed by an organosiloxane bond and a modified resin thereof (for example, a modified resin formed with an alkyd resin, a polyester resin, an epoxy resin, polyurethane or the like); a fluorocarbon resin such as polytetrachloro ethylene, polyvinyl fluoride, polyvinylidene fluoride, or polychlorotrifluoro ethylene; a polyamide resin; a polyester resin; a polyurethane resin; a polycarbonate resin; an amino resin such as a urea-formaldehyde resin; and an epoxy resin.

Among these resins, a (meth)acrylic resin, which adheres well to the core particle and is fixed by imparting a mechanical impact or heat to easily form a resin coating layer, is preferably used. Here, (meth)acrylic means acrylic or methacrylic.

Examples of a monomer to constitute the (meth)acrylic resin include a chain (meth)acrylic ester compound such as methyl(meth)acrylate, ethyl(meth)acrylate, propyl(meth)acrylate, n-butyl(meth)acrylate, hexyl(meth)acrylate, octyl(meth)acrylate, or 2-ethylhexyl(meth)acrylate; and an alicyclic(meth)acrylic ester compound having a cycloalkyl ring, such as cyclopropyl(meth)acrylate, cyclobutyl(meth)acrylate, cyclopentyl(meth)acrylate, cyclohexyl(meth)acrylate, cycloheptyl(meth)acrylate, cyclooctyl(meth)acrylate, isobornyl acrylate, dicyclopentanyl acrylate, methylcyclohexyl acrylate, trimethylcyclohexyl acrylate, t-butylcyclohexyl acrylate, cyclohexylphenyl acrylate, cyclododecyl acrylate, or adamantyl acrylate. These monomers can be used singly or in combination of two or more kinds thereof.

Among these monomers, it is preferable to use at least an alicyclic(meth)acrylic ester compound as a monomer from a viewpoint of obtaining both abrasion resistance and electric resistance. That is, the coating resin of the first carrier and the coating resin of the second carrier each preferably contain a constitutional unit derived from an alicyclic(meth) acrylic ester compound.

In addition, a monomer containing a cycloalkyl group having five to eight carbon atoms is preferable, and cyclohexyl methacrylate is more preferable from viewpoints of mechanical strength, environmental stability of a charged amount, and the like.

As the monomer to constitute the (meth)acrylic resin, a monomer other than a (meth)acrylic ester compound may be used. Examples of the other monomers include a styrene compound such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, or p-n-dodecylstyrene; an olefin compound such as ethylene, propylene, or isobutylene; a vinyl halide compound such as vinyl chloride, vinylidene chloride, vinyl bromide, vinyl fluoride, or vinylidene fluoride; a vinyl ester compound such as vinyl propionate, vinyl acetate, or vinyl benzoate; a vinyl ether compound such as vinylmethyl ether or vinylethyl ether; a vinyl ketone compound such as vinylmethyl ketone, vinylethyl ketone, or vinylhexyl ketone; an N-vinyl compound such as N-vinlycarbazole, N-vinylindole, or N-vinylpyrrolidone; a vinyl compound such as vinylnaphthalene or vinylpyridine; an acrylic acid derivative and a methacrylic acid derivative such as acrylonitrile, methacrylonitrile, or acrylamide. These other monomers can be used singly or in combination of two or more kinds thereof.

As a monomer other than an alicyclic(meth)acrylic ester compound, styrene and methylmethacrylate are preferable from viewpoints of mechanical strength, environmental stability of a charged amount, and the like. For example, a copolymer of cyclohexyl methacrylate and methyl methacrylate is preferably used because a surface of a carrier is easily refreshed and stress resistance in a developing machine is excellent.

The use amount of an alicyclic(meth)acrylic ester compound in a (meth)acrylic ester resin is preferably from 5 to 90% by mass, and more preferably from 10 to 80% by mass, relative to the total mass of the monomers.

The weight average molecular weight of a coating resin is preferably from 20,000 to 1,000,000, and more preferably from 30,000 to 700,000. The weight average molecular weight of the coating resin can be measured by a method described in Examples.

The glass transition temperature (Tg) of a coating resin (polymer obtained by polymerizing the above-described monomers) is preferably from 60 to 180° C., and more preferably from 80 to 150° C.

[Method of Preparing Coating Resin]

A method of preparing a coating resin is not particularly limited, but a conventionally known polymerization method can be used appropriately. Examples thereof include a pulverizing method, an emulsification dispersion method, a suspension polymerization method, a solution polymerization method, a dispersion polymerization method, an emulsion polymerization method, an emulsion polymerization aggregation method, and another known method. Particularly, synthesis by an emulsion polymerization method is preferable from a viewpoint of controlling a particle diameter.

A polymerization initiator, a surfactant, a chain-transfer agent used if necessary, or the like, other than the above-described monomers used in the emulsion polymerization method, and a polymerization condition such as polymerization temperature are not particularly limited. A conventionally known polymerization initiator, surfactant, chain-transfer agent, or the like can be used. Also as the polymerization condition such as polymerization temperature, a conventionally known polymerization condition can be used appropriately. Specifically, it is preferable to perform emulsion polymerization using various additives described in Examples below. That is, the above-described monomers are preferably subjected to emulsion polymerization using sodium benzenesulfonate as an anionic surfactant, water (ion-exchanged water) as a solvent, and ammonium peroxodisulfate as a polymerization initiator.

<Conductive Fine Particle>

A resin coating layer formed from a coating resin preferably includes a conductive fine particle in order to adjust a dynamic current value of a carrier. By adding a conductive fine particle to the resin coating layer, a volume resistance value (volume resistivity) of the resin coating layer is adjusted, and a dynamic current value of a carrier is adjusted.

The conductive fine particle is not particularly limited as long as the conductive fine particle has a relatively smaller resistance than the coating resin. Examples thereof include carbon black, titania, iron powder, zinc oxide, and tin oxide. These conductive fine particles can be used singly or in combination of two or more kinds thereof.

Among these conductive fine particles, carbon black is preferable from a viewpoint of being easily joined to a resin and easily adjusting a volume resistance value when being mixed with a resin. A characteristic of carbon black changes according to a method of preparing the same. However, in the present invention, as carbon black, it is possible to use any one of furnace black, acetylene black, channel black, and thermal black. The volume resistance value of a conductive fine particle is preferably from $1\times10^{-2}$ to $1\times10^{5}$ [Ω·cm] in terms of adjusting the volume resistance value of the resin coating layer. A preferable addition amount of a conductive fine particle will be described below.

[Method of Preparing Carrier]

Specific examples of a method of preparing the carrier having a core particle of which the surface is coated with a coating resin, according to an aspect of the present invention, include a wet type coating method and a dry type coating method.

Hereinafter, each method will be described in detail.

<Wet Type Coating Method>

Examples of the wet type coating method include the following (1) to (3):

(1) Fluidized Layer Type Spray Coating Method

A method of preparing a carrier particle having a core particle of which the surface is coated with a coating resin by spray coating the surface of the core particle with a coating liquid obtained by dissolving a coating resin in a solvent using a fluidized layer (or a fluidized bed) and then drying the coated core particle;

(2) Immersion Type Coating Method

A method of preparing a carrier particle having a core particle of which the surface is coated with a coating resin by immersing a core particle in a coating liquid obtained by dissolving a coating resin in a solvent to perform a coating treatment and then drying the coated core particle; and (3) Polymerization Method A method of preparing a carrier particle having a core particle of which the surface is coated with a coating resin by immersing a core particle in a coating liquid obtained by dissolving a reactive compound for forming a coating resin (including a polymerization initiator in addition to a monomer for synthesizing the coating resin) in a solvent to perform a coating treatment and then performing a polymerization reaction by imparting heat or the like to form a resin coating layer.

<Dry Type Coating Method>

Examples of the dry type coating method include a method of preparing a carrier particle having a core particle of which the surface is coated with a coating resin by making a coating resin adhere to a surface of a core particle to be coated and then imparting a mechanical impact to melt or soften and fix the coating resin adhering to the surface of the core particle to be coated.

As the dry type coating method described above, the following method (type) can be used. Specifically, first, a core particle, a coating resin, and a conductive fine particle if necessary are stirred at a high speed under non-heating or heating using a high speed stirring mixing machine which can impart a mechanical impact, and an impact is imparted to the mixture repeatedly. In this way, a coating resin is melted or softened and fixed to the surface of the core particle to form a resin coating layer. In this way, it is possible to manufacture a carrier having a resin coating layer obtained by coating a surface of a core particle with a coating resin. When heating is performed, the temperature is preferably from 60 to 130° C. This is because an excessively high heating temperature might cause aggregation of carriers easily. That is, when heating is performed within the above-described temperature range, aggregation of carriers would not occur, a coating resin is fixed to a surface of a core particle, and a uniform layer-shaped resin coating layer can be formed.

As the method of preparing a carrier having a core particle of which the surface is coated with a coating resin, the dry type coating method described above is particularly preferably used from viewpoints of a small environmental load without using a solvent and being capable of coating a surface of a core particle uniformly with a coating resin. This dry type coating method includes at least the following steps.

First step: mixing (mechanically stirring) materials obtained by blending appropriate amounts of a core particle, a coating resin, and an additive added if necessary, such as a conductive fine particle, at room temperature (20 to 30° C.) to make the coating resin and the additive added if necessary adhere to the surface of each core particle so as to have a uniform layer shape;

Second step: subsequently melting or softening and fixing the coating resin adhering to the surface of the core particle by imparting a mechanical impact or heat to form a resin coating layer; and Third step: subsequently cooling to room temperature (20 to 30° C.).

It is also possible to form a resin coating layer having a desired thickness by repeating the first to third steps multiple times, if necessary.

The addition amount of the coating resin blended in the above first step is preferably from one to seven parts by mass relative to 100 parts by mass of the core particle. The addition amount of the coating resin of one part by mass or more relative to 100 parts by mass of the core particle is preferable in terms of being capable of coating the core particle with the coating resin completely. The addition amount of the coating resin of seven parts by mass or less relative to 100 parts by mass of the core particle is preferable in terms of being capable of suppressing generation of agglomerated particles and forming the uniform resin coating layer on the core particle.

As the above second step, it is preferable to use a step of imparting a mechanical impact while the core particle to which the coating resin adheres is heated to the glass transition temperature of the coating resin or higher, spreading the coating resin on the surface of the core particle, fixing the coating resin thereto, and coating the surface of the core particle with the coating resin to form a resin coating layer.

Examples of an apparatus to impart a mechanical impact or heat in the above second step include a grinding machine having a rotor and a liner, such as a turbo mill, a pin mill, or a Kryptron, and a high-speed mixing machine with a stirring blade. Among these apparatuses, a high-speed stirring mixing machine with a horizontal rotary wing is preferable because a resin coating layer can be formed satisfactorily.

In the above second step, the time for imparting a mechanical impact or heat depends on an apparatus, but usually from 10 to 100 minutes. When a mechanical impact or heat is imparted during a period of time within such a range, aggregation of carriers would not easily occur, a coating resin can be fixed to a surface of a core particle more uniformly, and an excellent resin coating layer can be formed.

When a high-speed stirring mixing machine with a horizontal rotary wing is used, the peripheral speed of the horizontal rotary wing is preferably from 3 to 20 m/sec, and more preferably from 4 to 15 m/sec. When the peripheral speed of the horizontal rotary wing is 3 m/sec or more, a coating resin can be fixed to a surface of a core particle without causing blocking, and an excellent resin coating layer can be formed. When the peripheral speed of the horizontal rotary wing is 20 m/sec or less, a coating resin can be fixed to a surface of a core particle without breaking a resin coating layer or breaking a core particle itself constituting a carrier, and an excellent resin coating layer can be formed.

When heating is performed in the above second step, the heating temperature is preferably in a temperature range 5 to 20° C. higher than the glass transition temperature of the coating resin. Specifically, the heating temperature is preferably from60 to 130° C. When heating is performed within such a temperature range, aggregation of carrier particles would not occur, a coating resin is fixed to a surface of a core particle, and a uniform layer-shaped resin coating layer can be formed.

In the above-described dry type coating method, an organic solvent or the like is not used. Therefore, it is possible to form a resin coating layer which not only has no hole where a solvent has come out, is dense and firm but also has excellent adhesion to a core particle and to manufacture a carrier.

<Film Thickness of Resin Coating Layer>

The film thickness of a resin coating layer is preferably from 0.05 to 4 μm, and more preferably from 0.2 to 3 μm. When the film thickness of a resin coating layer is within the above range, a charging property and durability of a carrier can be improved.

The film thickness of a resin coating layer can be determined by the following method.

A carrier particle is cut by a plane passing through the center of the carrier particle using a focused ion beam apparatus "SMI 2050" (manufactured by Hitachi High-Tech Science Corporation), and a measurement sample is prepared. The cross section of the measurement sample is observed using a transmission electron microscope"JEM-2010F" (manufactured by JEOL Ltd.) in a field of view at a magnification of 5000. An average value of a part having a maximum film thickness and a part having a minimum film thickness in the field of view is adopted as a film thickness of a resin coating layer. The number of measurement is 50. When one photographic field of view is insufficient, the number of field of view is increased until the number of measurement becomes 50.

<Dynamic Current Value of Carrier>

In the present invention, a dynamic current value of a carrier is a dynamic current value measured when a voltage of 100 V is applied only to an isolated carrier. Electrically, the dynamic current value of a carrier at 100 V (Ic of the first carrier and Iw of the second carrier) is not particularly limited as long as formula (1) above is satisfied, but is preferably from 0.05 to 10 μA, more preferably from 0.1 to 8 μA, and still more preferably from 0.1 to 3 μA. When the dynamic current value of the carrier is within the above range, in actual photographing at the time of initial use, an edge effect that a central part of a solid image has a low concentration and an end part has a high concentration can be suppressed, and adhesion of a carrier and scattering of a toner can be sufficiently suppressed even after use for a long time. When the dynamic current value is too small, a charge held by a carrier is too high, and a holding property of a toner by the carrier is excessively increased. Therefore, an image memory may be generated. When the dynamic current value is too large, a charge held by a carrier is too low, and a holding property of a toner by the carrier is excessively reduced. Therefore, a toner may be scattered.

The dynamic current value of the carrier at 100 V is measured under conditions of developing with a magnetic brush. Specifically, the dynamic current value can be measured using the measuring apparatus illustrated in FIG. 1 and the following measuring method. That is, in FIG. 1, an aluminum electrode drum 11 having a diameter of 80 mmϕ is replaced with a photoreceptor drum. A magnetic brush is formed by supplying 5 g of a carrier 20 onto a developing sleeve 12. This magnetic brush is rubbed with an electrode drum 13. A voltage (100 V) is applied between the developing sleeve 12 and the electrode drum 13 with a direct current power source 14. The dynamic current value flowing between the developing sleeve 12 and the electrode drum 13 is measured using an ammeter 15. Measuring conditions are as follows.

<Conditions for Measuring Dynamic Current Value>

The number of rotations of sleeve: 100 rpm

Applied voltage: 100 V

Amount of sample: 5 g

Sleeve

Length in a longitudinal direction: 60 mm, Diameter: 37.5 mm,

Surface magnetic flux density: 1300 gauss

The number of magnet magnetic pole: 8

Aluminum electrode drum

Length in a longitudinal direction: 60 mm, Diameter: 80 mm

Width of developing nip: 1 cm

Distance between developing sleeve and drum: 0.6 mm

Environment: 20° C., 50% RH

In the present invention, the dynamic current value Ic (μA) of the first carrier contained in a color developer at 100 V and the dynamic current value Iw (μA) of the second carrier contained in a white developer at 100 V satisfy the relation of the above formula (1). When the relation of the above formula (1) is not satisfied, transfer unevenness of a color toner and a white toner occurs.

The above Iw (μA) preferably satisfies the following formula (2) from a viewpoint of exhibiting the effect of the present invention more.

[Numerical formula 3]

$$0.1\ \mu A < Iw < 2.0\ \mu A \quad (2)$$

In addition, a ratio (Iw/Ic) between the above Iw (μA) and the above Ic (μA) preferably satisfies formula following (3) from a viewpoint of suppressing initial transfer unevenness.

[Numerical formula 4]

$$0.10 < Iw/Ic < 0.25 \quad (3)$$

The relation of the above formula (1) can be controlled by a material of a core particle in the first carrier or the second carrier, a film thickness of a resin coating layer, the kind and an addition amount of a conductive fine particle, and the like. However, the control is preferably performed by a content of a conductive fine particle contained in a resin coating layer from viewpoints of adjusting carrier magnetization and fluctuation of durability due to depletion of a resin coating layer.

More specifically, preferably, the first carrier and the second carrier each have a resin coating layer containing a coating resin and a conductive fine particle on a surface of a core particle, the kind of the coating resin of the first carrier is the same as that of the coating resin of the second carrier, the kind of the conductive fine particle of the first carrier is the same as that of the conductive fine particle of the second carrier, and the following formula (4) is satisfied wherein Ac (parts by mass) is a content of the conductive fine particle relative to 100 parts by mass of the coating resin in the resin coating layer of the first carrier and Aw (parts by mass) is a content of the conductive fine particle relative to 100 parts by mass of the coating resin in the resin coating layer of the second carrier.

[Numerical formula 5]

$$0 \leq Aw < Ac \quad (4)$$

It is preferable to satisfy the relation of the above formula (4) because transfer unevenness of an image can be suppressed over a long period of time. Furthermore, Aw is preferably less than 10 parts by mass, and more preferably Aw=0. That is, the resin coating layer of the second carrier preferably contains no conductive fine particle.

In addition, the kind of the coating resin of the first carrier is preferably the same as that of the second carrier because a depletion rate of a resin coating layer in the first carrier due to use for a long time can be almost similar to that in the second carrier, and transfer unevenness of an image can be suppressed over a long period of time.

Here, the above "the kind of the coating resin of the first carrier is the same as that of the second carrier" means that a characteristic chemical bond is contained commonly in a repeating unit of the coating resin of the first carrier and a repeating unit of the coating resin of the second carrier. The same type of resin will be described in detail in the following section (Hybrid crystalline polyester resin (hybrid resin)), and therefore description thereof will be omitted here.

The "the kind of the conductive fine particle of the first carrier is the same as that of the conductive fine particle of the second carrier" means that a main element of the conductive fine particle of the first carrier is the same as that of the conductive fine particle of the second carrier. The "main element" means an element of which the content is more than 50% by atom wherein a total amount of atoms contained in the conductive fine particle is 100% by atom.

[Color Toner and White Toner]

The color toner and the white toner according to an aspect of the present invention each contain a toner particle obtained by making an external additive adhere to a toner base particle, if necessary.

<Toner Base Particle>

Specifically, the toner base particle according to the present embodiment contains at least a binder resin (hereinafter, also referred to as a "resin for a toner"). The color toner contains at least one kind selected from the group consisting of a colorant for yellow, a colorant for magenta, and a colorant for cyan. The white toner contains at least titanium oxide as a pigment. This toner base particle may further contain another component such as a release agent or a charge control agent, if necessary.

<<Binder Resin>>

As a binder resin constituting a toner base particle, a thermoplastic resin is preferably used.

As such a binder resin, a binder resin generally used as a binder resin constituting a toner can be used without any particular limitation. Specific examples thereof include a styrene resin, an acrylic resin, a styrene-acryl copolymer resin, a polyester resin, a silicone resin, an olefin resin, an amide resin, and an epoxy resin.

Among these binder resins, a styrene resin, an acrylic resin, a styrene-acryl copolymer resin, and a polyester resin, having a low viscosity and a high sharp melt property as melting characteristics, are preferable. The binder resin can be used singly or in combination of two or more kinds thereof. Particularly, the binder resin preferably contains a crystalline polyester resin from viewpoints of easily melting a toner particle, improving a low temperature fixability and an electrophotography characteristic, and suppressing transfer unevenness over a long period of time.

(Crystalline Polyester Resin)

A crystalline polyester resin means a known polyester resin obtained by a polycondensation reaction between a divalent or higher carboxylic acid (polycarboxylic acid) and a dihydric or higher alcohol (polyhydric alcohol), and exhibiting not a step-shaped endothermic change but a clear endothermic peak in differential scanning calorimetry (DSC) of a toner. The clear endothermic peak specifically means a peak having a half-value width of an endothermic peak within 15° C. when differential scanning calorimetry (DSC) described in Examples is performed at a temperature rising rate of 10° C./min.

A crystalline polyester resin is generated from a polycarboxylic acid component and a polyhydric alcohol component. The valence number of each of the polycarboxylic acid component and the polyhydric alcohol component is preferably 2 or 3, and particularly preferably 2. Therefore, as a particularly preferable form, a case of the valence number 2 (that is, a dicarboxylic acid component and a diol component) will be described.

As the dicarboxylic acid component, an aliphatic dicarboxylic acid is preferably used, and an aromatic dicarboxylic acid may be used together. As the aliphatic dicarboxylic acid, a straight-chain type is preferably used. By using a straight-chain type dicarboxylic acid, crystallinity is improved advantageously. The dicarboxylic acid component is not limited to one kind, but two or more kinds thereof may be mixed and used.

Examples of the aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid (dodecanedicarboxylic acid), 1,13-tridecanedicarboxylic acid, 1,14-tetradecanedicarboxylic acid, 1,16-hexadecanedicarboxylic acid, 1,18-octadecanedicarboxylic acid, and cyclohexanedicarboxylic acid. A lower alkyl ester or an acid anhydride thereof can be also used.

Examples of the aromatic dicarboxylic acid which can be used together with the aliphatic dicarboxylic acid include terephthalic acid, isophthalic acid, orthophthalic acid, t-butylisophthalic acid, 2,6-naphthalenedicarboxylic acid, and 4,4'-biphenyldicarboxylic acid. Among these aromatic dicarboxylic acids, terephthalic acid, isophthalic acid, or t-butylisophthalic acid is preferably used from viewpoints of availability easiness and emulsification easiness.

As the dicarboxylic acid component to form a crystalline polyester resin, the content of an aliphatic dicarboxylic acid is preferably 50% by constitutional mol or more, more preferably 70% by constitutional mol or more, still more preferably 80% by constitutional mol or more, and particularly preferably 100% by constitutional mol. By the content of the aliphatic dicarboxylic acid in the dicarboxylic acid component of 50% by constitutional mol or more, it is possible to secure crystallinity of a crystalline polyester resin sufficiently.

As the diol component, an aliphatic diol is preferably used, and a diol other than the aliphatic diol may be contained, if necessary. As the aliphatic diol, a straight-chain type is preferably used. By using a straight-chain type dicarboxylic acid, crystallinity is improved advantageously. These diol components may be used singly or in combination of two or more kinds thereof.

Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol.

Examples of the diol other than the aliphatic diol, used if necessary, include a diol having a double bond and a diol having a sulfonic acid group. Specific examples of the diol having a double bond include 2-butene-1,4-diol, 3-butene-1,6-diol, and 4-butene-1,8-diol.

As the diol component to form a crystalline polyester resin, the content of an aliphatic diol is preferably 50% by constitutional mol or more, more preferably 70% by constitutional mol or more, still more preferably 80% by constitutional mol or more, and particularly preferably 100% by constitutional mol. By the content of the aliphatic diol in the diol component of 50% by constitutional mol or more, it is possible to secure crystallinity of a crystalline polyester resin, to obtain a toner having an excellent low temperature fixability, and to obtain glossiness of an image finally formed.

A method of forming a crystalline polyester resin is not particularly limited. It is possible to form the resin by polycondensation (esterification) between the above polycarboxylic acid and polyhydric alcohol using a known esterification catalyst.

As a use ratio between the above polyhydric alcohol component and polycarboxylic acid component, an equivalent ratio [OH]/[COOH], in which [OH] is an equivalence of hydroxyl groups in a diol component and [COOH] is an equivalence of carboxyl groups in a dicarboxylic acid component, is preferably from 1.5/1 to 1/1.5, and more preferably from 1.2/1 to 1/1.2.

Examples of a catalyst which can be used in manufacturing a crystalline polyester resin include an alkali metal compound such as sodium or lithium; a compound containing a group 2 element such as magnesium or calcium; a metal compound such as aluminum, zinc, manganese, antimony, titanium, tin, zirconium, or germanium; a phosphorous acid compound; a phosphoric acid compound; and an amine compound. Specific examples of the tin compound include dibutyltin oxide, tin octylate, tin dioctylate, and salts thereof. Examples of the titanium compound include a titanium alkoxide such as tetra-n-butyl titanate, tetraisopropyl titanate, tetramethyl titanate, or tetrastearyl titanate; a titanium acylate such as polyhydroxy titanium stearate; and a titanium chelate such as titanium tetraacetylacetonate, titanium lactate, or titanium triethanolaminate. Examples of the germanium compound include germanium dioxide. Examples of the aluminum compound include an oxide such as polyaluminum hydroxide, and an aluminum alkoxide such as tributylaluminate. These compounds may be used singly or in combination of two or more kinds thereof.

The polymerization temperature and the polymerization time are not particularly limited. The pressure in a reaction system may be reduced during polymerization, if necessary.

(Hybrid Crystalline Polyester Resin (Hybrid Resin))

Furthermore, the crystalline polyester resin is preferably a hybrid crystalline polyester resin (hereinafter, also simply referred to as a hybrid resin) in which a crystalline polyester resin unit and an amorphous resin unit other than a polyester resin are chemically bonded. The crystalline polyester resin unit contained in the hybrid resin is hardly exposed to a surface of a toner, and therefore charging performance of the toner is more stable and transfer unevenness is further suppressed over a long period of time. Herein, "a unit" can be used for the same meaning as "a segment."

<<Crystalline Polyester Resin Unit>>

The crystalline polyester resin unit indicates a part derived from a crystalline polyester resin. That is, the crystalline polyester resin unit indicates a molecular chain having the same chemical structure as the above crystalline polyester resin. The amorphous resin unit other than a polyester resin indicates a part derived from an amorphous resin other than a polyester resin. That is, the amorphous resin unit other than a polyester resin indicates a molecular chain having the same chemical structure as the amorphous resin other than a polyester resin.

A monomer to constitute the crystalline polyester resin unit, a method of forming the unit, or the like is similar to those described above (crystalline polyester resin), and therefore description thereof will be omitted here.

In the hybrid resin, the content of the crystalline polyester resin unit is preferably 50% by mass or more and 98% by mass or less, and more preferably 70% by mass or more and 95% by mass or less, relative to the total amount of the hybrid resin. By the content within the above range, it is possible to impart sufficient crystallinity to the hybrid resin. A constitutional component of each unit and a content ratio thereof in the hybrid resin can be specified, for example, by an NMR measurement or a methylation reaction P-GC/MS measurement.

The hybrid resin includes an amorphous resin unit other than a polyester resin, described in detail below, in addition to the above crystalline polyester resin unit. The hybrid resin may be a block copolymer, a graft copolymer, or the like as long as the hybrid resin includes the above crystalline polyester resin unit and amorphous resin unit other than a polyester resin, but is preferably a graft copolymer. A hybrid resin in a form of a graft copolymer makes it easy to control orientation of the crystalline polyester resin unit and can impart sufficient crystallinity to the hybrid resin.

In addition, the crystalline polyester resin unit is preferably grafted onto an amorphous resin unit other than a polyester resin as a main chain from the above-described viewpoint. That is, the hybrid crystalline polyester resin is preferably a graft copolymer having an amorphous resin unit other than a polyester resin as a main chain and having a crystalline polyester resin unit as a side chain.

The above-described embodiment makes it possible to further enhance orientation of the crystalline polyester resin unit and to improve crystallinity of the hybrid resin.

A substituent such as a sulfonic acid group, a carboxyl group, or a urethane group may be introduced into the hybrid resin. The substituent maybe introduced into the crystalline polyester resin unit or an amorphous resin unit other than a polyester resin, described in detail below.

<<Amorphous Resin Unit Other than Polyester Resin>>

The amorphous resin unit other than a polyester resin is a part derived from an amorphous resin other than the crystalline polyester resin. It can be confirmed that an amorphous resin unit is contained in the hybrid resin (also in a toner) by, for example, specifying a chemical structure using an NMR measurement, a P-GC/MS measurement, a methylation reaction P-GC/MS measurement, and the like.

The amorphous resin unit is a resin unit having no melting point but having a relatively high glass transition temperature (Tg) if a resin having the same chemical structure and molecular weight as the unit is subjected to differential scanning calorimetry (DSC).

The amorphous resin unit is not particularly limited as long as the amorphous resin unit is as defined above. For example, a resin having a structure obtained by copolymerizing another component to a main chain of an amorphous resin unit or a resin having a structure obtained by copolymerizing an amorphous resin unit to a main chain of another component corresponds to the hybrid resin having an amorphous resin unit, described in the present invention, as long as a toner containing this resin contains the above amorphous resin unit.

The amorphous resin unit preferably includes the same type of resin as an amorphous resin contained in a binder resin (that is, a resin other than a hybrid resin). By such a form, an affinity between a hybrid resin and an amorphous resin is further improved, the hybrid resin is introduced into the amorphous resin more easily, and charging uniformity or the like is further improved.

Here, "the same type of resin" means that a characteristic chemical bond is commonly contained in repeating units. Here, the "characteristic chemical bond" is in conformity with "polymer classification" described in National Institute for Materials Science (NIMS) Materials Database (http://polymer.nims.go.jp/PoLyInfo/guide/jp/term_polymer.html). That is, the "characteristic chemical bond" refers to a chemical bond to constitute a polymer classified into 22 kinds of polymers of polyacrylate, polyamide, polyacid anhydride, polycarbonate, polydiene, polyester, polyhaloolefin, polyimide, polyimine, polyketone, polyolefin, polyether, polyphenylene, polyphosphazen, polysiloxane, polystyrene, polysulfide, polysulfone, polyurethane, polyurea, polyvinyl, and other polymers.

In a case where the resin is a copolymer, the "the same type of resin" indicates resins having a common characteristic chemical bond when chemical structures of a plurality of monomers to constitute the copolymer contain a constitutional unit of a monomer having the above chemical bond. Therefore, even when characteristics exhibited by resins themselves are different from each other or even when molar ratios of monomers to constitute a copolymer are different from each other, these are assumed to be the same type of resin as long as the resins have a common characteristic chemical bond.

For example, a resin (or a resin unit) formed by styrene, butyl acrylate, and acrylic acid and a resin (or a resin unit) formed by styrene, butyl acrylate, and methacrylic acid each contain at least a chemical bond to constitute polyacrylate, and therefore are the same type of resin. Furthermore, for example, a resin (or a resin unit) formed by styrene, butyl acrylate, and acrylic acid and a resin (or a resin unit) formed by styrene, butyl acrylate, acrylic acid, terephthalic acid, and fumaric acid each contain at least a chemical bond to constitute polyacrylate as a common chemical bond. Therefore, these are the same type of resin.

A resin component to constitute an amorphous resin unit is not particularly limited. Examples thereof include a vinyl resin unit, a urethane resin unit, and a urea resin unit. Among these units, a vinyl resin unit is preferable because it is easy to control thermoplasticity.

The vinyl resin unit is not particularly limited as long as the vinyl resin unit is obtained by polymerizing a vinyl compound. Examples thereof include an acrylic ester resin unit, a styrene-acrylic ester resin unit (styrene-acrylic resin unit), and an ethylene-vinyl acetate resin unit. These units may be used singly or in combination of two or more kinds thereof.

A method of forming the vinyl resin unit is not particularly limited. Examples thereof include a method of polymerizing a monomer using a known oil-soluble or water-soluble polymerization initiator. Specific examples of the oil-soluble polymerization initiator include an azo type or diazo type polymerization initiator and a peroxide type polymerization initiator.

Examples of the azo type or diazo type polymerization initiator include 2, 2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

Examples of the peroxide type polymerization initiator include benzoyl peroxide, methylethylketone peroxide, diisopropyl peroxycarbonate, cumene hydroperoxide, t-butylhydro peroxide, di-t-butylperoxide, dicumyl peroxide, 2,4-dichlorobenzoyl peroxide, lauroyl peroxide, 2,2-bis-(4, 4-t-butylperoxycyclohexyl)propane, and tris-(t-butylperoxy)triazine.

When a resin particle is formed by an emulsion polymerization method, it is possible to use a water-soluble radical polymerization initiator. Examples of the water-soluble polymerization initiator include a persulfate such as potassium persulfate or ammonium persulfate, azobisaminodipropane acetate, azobiscyanovaleric acid and a salt thereof, and hydrogen peroxide.

The content of the amorphous resin unit is preferably 2% by mass or more and 50% by mass or less relative to the total amount of the hybrid resin. The above content is more preferably 5% by mass or more and 30% by mass or less. By the content within the above range, it is possible to impart sufficient crystallinity to the hybrid resin.

<<Method of Preparing Hybrid Crystalline Polyester Resin (Hybrid Resin)>>

A method of preparing a hybrid crystalline resin contained in a binder resin according to an aspect of the present invention is not particularly limited as long as the method makes it possible to form a polymer having a structure in which the crystalline polyester resin unit and the amorphous resin unit are molecularly bonded to each other. Specific examples of a method of preparing a hybrid resin include the following method.

(1) A method of preparing a hybrid resin by polymerizing an amorphous resin unit in advance and performing a polymerization reaction to form a crystalline polyester resin unit in the presence of the amorphous resin unit.

In this method, first, a monomer to constitute the above amorphous resin unit (preferably a vinyl monomer such as a styrene monomer or a (meth)acrylic ester monomer) is subjected to an addition reaction to form an amorphous resin unit. Subsequently, a polycarboxylic acid and a polyhydric alcohol are subjected to a polymerization reaction to form a crystalline polyester resin unit in the presence of the amorphous resin unit. At this time, the polycarboxylic acid and the polyhydric alcohol are subjected to a condensation reaction, and the polycarboxylic acid or the polyhydric alcohol is subjected to an addition reaction to the amorphous resin unit, thereby forming a hybrid resin.

In the above method, a portion which can make these units react with each other is preferably incorporated into the crystalline polyester resin unit or the amorphous resin unit. Specifically, when the amorphous resin unit is formed, a compound having a portion which can react with a carboxy group [—COOH] or a hydroxyl group [—OH] remaining in the crystalline polyester resin unit and a portion which can react with the amorphous resin unit is used in addition to a monomer to constitute the amorphous resin unit. That is, by a reaction between this compound and a carboxy group [—COOH] or a hydroxyl group [—OH] in the crystalline polyester resin unit, the crystalline polyester resin unit can be chemically bonded to the amorphous resin unit.

Alternatively, when the crystalline polyester resin unit is formed, a compound having a portion which can react with a polyhydric alcohol or a polycarboxylic acid and can react with the amorphous resin unit may be used.

By using the above method, it is possible to form a hybrid resin having a structure (graft structure) in which a crystalline polyester resin unit is molecularly bonded to an amorphous resin unit.

(2) A Method of Preparing a Hybrid Resin by Forming a Crystalline Polyester Resin Unit and an Amorphous Resin Unit Separately and Bonding These Units In this method, first, a polycarboxylic acid and a polyhydric alcohol are subjected to a condensation reaction to form a crystalline polyester resin unit. Apart from the reaction system of forming the crystalline polyester resin unit, monomers to constitute the above amorphous resin unit are subjected to addition polymerization to form an amorphous resin unit. At that time, it is preferable to incorporate, in the crystalline polyester resin unit and the amorphous resin unit, a portion which enables these units to react with each other. A method of incorporating such a reactive portion is the same as described above. Therefore, detailed description thereof will be omitted.

Subsequently, by reacting the above-formed crystalline polyester resin unit and amorphous resin unit with each other, it is possible to form a hybrid resin having a structure in which the crystalline polyester resin unit and the amorphous resin unit are molecularly bonded to each other.

When the reactive portion is not incorporated into a crystalline polyester resin unit nor an amorphous resin unit, the following method may be adopted. Namely, a system containing both of the crystalline polyester resin unit and the amorphous resin unit is prepared, and then, a compound having portions which are reactive with the crystalline polyester resin unit and the amorphous resin unit is introduced in to the system. Via the compound, it is possible to form a hybrid resin having a structure in which a crystalline polyester resin unit and an amorphous resin unit are molecularly bonded to each other.

(3) A Method of Preparing a Hybrid Resin by Forming a Crystalline Polyester Resin Unit in Advance and Performing a Polymerization Reaction to Form an Amorphous Resin Unit in the Presence of the Crystalline Polyester Resin Unit.

In this method, first, a polycarboxylic acid and a polyhydric alcohol are subjected to condensation and polymerization to form a crystalline polyester resin unit. Subsequently, monomers to constitute an amorphous resin unit are subjected to polymerization to form an amorphous resin unit in the presence of the crystalline polyester resin unit. At that time, it is preferable to incorporate, in the crystalline polyester resin unit and the amorphous resin unit, a portion which enables these units to react with each other as in the above (1). A method of incorporating such a reactive portion is the same as described above. Therefore, detailed description thereof will be omitted.

By using the above method, it is possible to form a hybrid resin having a structure (graft structure) in which an amorphous resin unit is molecularly bonded to a crystalline polyester resin unit.

Among the above forming methods (1) to (3), the method (1) is preferable because it is easy to form a hybrid resin in which a crystalline polyester resin chain is grafted to an amorphous resin chain and a production process can be simplified. In the method (1), an amorphous resin unit is formed in advance, and then a crystalline polyester resin unit is bonded thereto. Therefore, orientation of the crystalline polyester resin unit becomes uniform easily. Therefore, the method (1) is preferable because a hybrid resin suitable for the present invention can be formed surely.

The number average molecular weight (Mn) of a crystalline polyester resin is preferably from 5,000 to 50,000 from viewpoints of an excellent low temperature fixability and image storage property. The number average molecular weight of a crystalline polyester resin is measured by GPC, and can be measured under similar measuring conditions to a coating resin.

(Amorphous Resin)

A binder resin preferably contains an amorphous resin together with the above hybrid resin. The amorphous resin is not particularly limited, but is a resin having no melting point but having a relatively high glass transition temperature (Tg) when the resin is subjected to a differential scanning calorimetry (DSC).

The amorphous resin preferably contains a resin component to constitute the unit described in the above section <<Amorphous resin unit other than polyester resin>>. That is, the amorphous resin is preferably a vinyl resin, a urethane resin, or a urea resin. The amorphous resin may be an amorphous polyester resin such as a styrene-acryl-modified polyester resin.

The amorphous resin contained in the binder resin preferably includes the same type of resin as the amorphous resin unit contained in the hybrid resin. Here, the "include the same type of resin" encompasses a form including only the same type of resin and a form including the same type of resin and another amorphous resin. However, in a form including the same type of resin and another amorphous resin, the content of the same type of resin is preferably 15% by mass or more, and more preferably 20% by mass or more, relative to the total amount of the amorphous resin.

Furthermore, the amorphous resin may be a copolymer having a unit derived from the same type of resin as the amorphous resin unit of the hybrid resin and a unit derived from another amorphous resin. In this case, the copolymer may be a block copolymer, a graft copolymer, or the like. The copolymer is preferably a graft copolymer from a viewpoint of easily controlling compatibility with the hybrid resin. However, in this case, the content of the unit derived from the same type of resin as the amorphous resin unit of the hybrid resin is preferably 15% by mass or more, and more preferably 20% by mass or more, relative to the total amount of the amorphous resin.

The definition of "the same type of resin" has been described in the above section <<Amorphous resin unit other than polyester resin>>. Therefore, detailed description thereof will be omitted.

A resin used as an amorphous resin is preferably a vinyl resin among the above resins. A vinyl resin is suitable in terms of easily controlling compatibility with a hybrid resin particularly when the amorphous resin unit of the hybrid resin is a vinyl resin unit.

Therefore, hereinafter, a vinyl resin will be described.

<<Vinyl Resin>>

When a vinyl resin is used as an amorphous resin, the vinyl resin is not particularly limited as long as the vinyl resin is obtained by polymerizing a vinyl compound. Examples thereof include an acrylic ester resin, a styrene-acrylic ester resin, and an ethylene-vinyl acetate resin. These vinyl resins may be used singly or in combination of two or more kinds thereof.

Among the above vinyl resins, a styrene-acrylic ester resin (styrene-acrylic resin) is preferable considering plasticity at the time of thermal fixing. As a monomer to constitute a styrene-acrylic resin, a compound similar to the compounds exemplified as the monomer to constitute the styrene-acrylic resin unit in the above section <<Amorphous resin unit other than polyester resin>> can be used.

Therefore, detailed description thereof will be omitted. Preferable examples of the styrene monomer include styrene, o-methyl styrene, m-methyl styrene, p-methyl styrene, α-methyl styrene, p-phenyl styrene, and p-ethyl styrene. Preferable examples of the (meth)acrylic ester monomer include an acrylic ester monomer such as methyl acrylate, ethyl acrylate, isopropyl acrylate, n-butyl acrylate, or isobutyl acrylate; and a methacrylic ester monomer such as methyl methacrylate, ethyl methacrylate, n-butyl methacrylate, isopropyl methacrylate, or isobutyl methacrylate. These styrene monomers and (meth)acrylic ester monomers can be used singly or in combination of two or more kinds thereof. By using the (meth)acrylic ester monomer, excellent thermal fixability and excellent plasticity can be exhibited.

In addition, another monomer may be polymerized. Examples thereof include acrylic acid, methacrylic acid, maleic acid, itaconic acid, cinnamic acid, fumaric acid, a maleic acid monoalkyl ester, anitaconic acid monoalkyl ester, 2-hydroxyethyl(meth)acrylate, 2-hydroxypropyl (meth)acrylate, 3-hydroxypropyl(meth)acrylate, 2-hydroxybutyl(meth)acrylate, 3-hydroxybutyl (meth)acrylate, 4-hydroxybutyl(meth)acrylate, and polyethylene glycol mono (meth)acrylate.

The content of a constitutional unit derived from the styrene monomer in the styrene-acrylic resin is preferably from 40 to 90% by mass relative to the total amount of the styrene-acrylic resin. The content of a constitutional unit derived from the (meth)acrylic ester monomer in the styrene-acrylic resin is preferably from 10 to 60% by mass relative to the total amount of the styrene-acrylic resin. By the content within these ranges, it is easy to control plasticity of an amorphous resin.

The content of a constitutional unit derived from the above other monomer in the styrene-acrylic resin is preferably from 0.5 to 30% by mass relative to the total amount of the styrene-acrylic resin.

A method of preparing a vinyl resin is not particularly limited. A vinyl resin can be manufactured by a method similar to the method of forming a vinyl resin unit described in the above section <<Amorphous resin unit other than polyester resin>>.

The weight average molecular weight (Mw) of the amorphous resin is preferably from 5, 000 to 150,000, and more preferably from 10,000 to 70,000 from a viewpoint of controlling plasticity thereof easily.

<Colorant for Color Toner>

Examples of a colorant which can be used as a colorant for a color toner include a known inorganic or organic colorant. Specific examples of the colorant will be described below.

Examples of a colorant for magenta include C. I. Pigment Red 2, the same 3, the same 5, the same 6, the same 7, the same 15, the same 16, the same 48:1, the same 53:1, the same 57:1, the same 60, the same 63, the same 64, the same 68, the same 81, the same 83, the same 87, the same 88, the same 89, the same 90, the same 112, the same 114, the same 122, the same 123, the same 139, the same 144, the same 149, the same 150, the same 163, the same 166, the same 170, the same 177, the same 178, the same 184, the same 202, the same 206, the same 207, the same 209, the same 222, the same 238, and the same 269.

Examples of a colorant for yellow include C. I. Pigment Orange 31 and the same 43, C. I. Pigment Yellow 12, the same 14, the same 15, the same 17, the same 74, the same 83, the same 93, the same 94, the same 138, the same 155, the same 162, the same 180, the same 185, and C. I. Solvent Yellow 93.

Examples of a colorant for cyan include C. I. Pigment Blue 2, the same 3, the same 15, the same 15:2, the same 15:3, the same 15:4, the same 16, the same 17, the same 60, the same 62, the same 66, and C. I. Pigment Green 7.

These colorants can be used singly or in combination of two or more kinds thereof, if necessary. The addition amount of the colorant is preferably from 1 to 30% by mass, and more preferably from 2 to 20% by mass, relative to the amount of the color toner.

A surface-modified colorant can be also used. As a surface-modifying agent therefor, a conventionally known surface-modifying agent can be used. Specific examples thereof include a silane coupling agent, a titanium coupling agent, and an aluminum coupling agent. These surface-modifying agents can be preferably used.

<Pigment for White Toner>

The white toner according to an aspect of the present invention contains at least titanium oxide as a pigment. Examples of a pigment other than titanium oxide include an inorganic pigment such as heavy calcium carbonate, light calcium carbonate, titanium dioxide, aluminum hydroxide, titanium white, talc, calcium sulfate, barium sulfate, zinc oxide, magnesium oxide, magnesium carbonate, amorphous silica, colloidal silica, white carbon, kaolin, baled kaolin, delaminated kaolin, aluminosilicate, sericite, bentonite, or smectite; and an organic pigment such as a polystyrene resin particle or a urea formaldehyde resin particle. Examples thereof also include a pigment having a hollow structure (for example, an inorganic pigment such as hollow silica). The pigment other than titanium oxide may be used singly or in combination of two or more kinds thereof.

The addition amount of the pigment is preferably from 10 to 50% by mass, and more preferably from 10 to 40% by mass, relative to the white toner.

In the present invention, a black toner can be used in addition to the color toner and white toner. Examples of a colorant of the black toner include carbon black such as channel black, furnace black, acetylene black, thermal black, or lamp black.

[Internal Additive]

<Release Agent>

The toner base particle may contain a release agent. The release agent is not particularly limited, but a known release agent can be used. Specific examples thereof include a polyolefin wax such as a polyethylene wax or a polypropylene wax; a branched chain hydrocarbon wax such as a microcrystalline wax; a long chain hydrocarbon wax such as a paraffin wax or a sasol wax; a dialkyl ketone wax such as distearyl ketone; an ester wax such as a carnauba wax, a montan wax, behenyl behenate, trimethylolpropane tribehenate, pentaerythritol tetrabehenate, pentaerythritol diacetate dibehenate, glycerin tribehenate, 1,18-octadecanediol distearate, tristearyl trimellitate, or distearyl maleate; and an amide wax such as ethylenediamine behenyl amide or trimellitic acid tristearyl amide. The melting point of the release agent is preferably from 40 to 160° C., more preferably from 50 to 120 ° C. By the melting point within the above range, a heat-resistant storage property of a toner is secured, and it is possible to form a stable toner image without causing cold offset or the like even when fixing is performed at a low temperature. The content of the release agent in a toner particle is preferably from 1 to 30% by mass, and more preferably from 5 to 20% by mass.

<Charge Control Agent>

The toner base particle may contain a charge control agent. Examples thereof include a metal complex of a salicylic acid derivative with zinc or aluminum (salicylic acid metal complex), a calixarene compound, an organic boron compound, and a fluorine-containing quaternary ammonium salt compound.

The content ratio of the charge control agent in a toner particle is preferably from 0.1 to 5 parts by mass relative to 100 parts by mass of a binder resin.

[External Additive]

An external additive may adhere to a surface of a toner base particle according to an aspect of the present invention in order to control fluidity or a charging property. As the external additive, a conventionally known metal oxide particle can be used. Examples thereof include a silica particle, a titania particle, an alumina particle, a zirconia particle, a zinc oxide particle, a chromium oxide particle, a cerium oxide particle, an antimony oxide particle, a tungsten oxide particle, a tin oxide particle, a tellurium oxide particle, a manganese oxide particle, and a boron oxide particle. These metal oxide particles may be used singly or in combination of two or more kinds thereof. These metal oxide particles may be subjected to a hydrophobic treatment, if necessary.

In addition, an organic fine particle such as a homopolymer of styrene, methyl methacrylate, or the like, or a copolymer thereof may be used as the external additive.

<Lubricant>

A lubricant maybe used as an external additive in order to further improve a cleaning property or a transfer property. Examples thereof include a metal salt of a higher fatty acid, such as zinc stearate, aluminum stearate, copper stearate, magnesium stearate, calcium stearate, zinc oleate, manganese oleate, iron oleate, copper oleate, magnesium oleate, zinc palmitate, copper palmitate, magnesium palmitate, calcium palmitate, zinc linoleate, calcium linoleate, zinc ricinoleate, or calcium ricinoleate.

The external additive can be used singly or in combination of two or more kinds thereof. The addition amount of the external additive is preferably from 0.1 to 10% by mass, and more preferably from 1 to 5% by mass, relative to the total amount of the toner particles.

<Method of Preparing Toner>

A method of preparing the toner according to an aspect of the present invention is not particularly limited. Examples thereof include a known method such as a kneading and pulverizing method, a suspension polymerization method, an emulsion aggregation method, a dissolution suspension method, a polyester elongation method, or a dispersion polymerization method.

Among these methods, the emulsion aggregation method is preferably used from viewpoints of uniformity of a particle diameter, controllability of a shape, and the like. Hereinafter, the emulsion aggregation method will be described.

(Emulsion Aggregation Method)

In the emulsion aggregation method, dispersion liquid, in which fine particle of a resin (hereinafter, also referred to as "resin fine particle") dispersed by a surfactant or a dispersion stabilizer, is mixed with dispersion liquid containing a constitutional component of a toner particle such as a fine particle of a colorant, the resulting mixture is agglomerated by adding an aggregation agent until a desired toner particle diameter is obtained, fusing is performed between the resin fine particles thereafter or at the same time as the aggregation, a shape thereof is controlled, and a toner particle is thereby formed.

Here, the resin fine particle can be a composite particle formed by a plurality of layers including two or more layers of resins having different compositions.

For example, the resin fine particle can be manufactured by an emulsion polymerization method, a mini emulsion polymerization method, a phase-transfer emulsification method, or a method in combination of some manufacturing methods. When the resin fine particle includes an internal additive, the mini emulsion polymerization method is preferably used among the above methods.

When the toner particle includes an internal additive, the resin fine particle may include an internal additive. Alternatively, a dispersion liquid of an internal additive fine particle including only the internal additive is separately prepared, and the internal additive fine particles may be agglomerated together therewith.

A toner particle having a core-shell structure can also be obtained by the emulsion aggregation method. Specifically, the toner particle having a core-shell structure can be obtained by agglomerating (and fusing) a binder resin fine particle for a core particle and a colorant to manufacture a core particle, and then, adding a binder resin fine particle for a shell part to the dispersion liquid of the core particle, and agglomerating and fusing the binder resin fine particle for a shell part on a surface of the core particle to form a shell part coating the surface of the core particle.

When a toner is manufactured by the emulsion aggregation method, a method of preparing a toner according to a preferable embodiment includes step (a) of preparing dispersion liquid of the crystalline polyester resin fine particle and dispersion liquid of the amorphous resin fine particle (hereinafter, also referred to as a preparing step) and step (b) of mixing the dispersion liquid of the crystalline polyester resin fine particle and the dispersion liquid of the amorphous resin fine particle to cause aggregation and fusion (hereinafter, also referred to as an agglomerating and fusing step).

Hereinafter, steps (a) and (b), and steps (c) to (e) optionally performed in addition to steps (a) and (b) will be described in detail.

(a) Preparing Step

Step (a) includes a step of preparing dispersion liquid of crystalline polyester resin fine particle and a step of preparing dispersion liquid of an amorphous resin fine particle, described below. Step (a) includes a step of preparing dispersion liquid of a colorant and a step of preparing a dispersion liquid of a release agent fine particle, if necessary.

(a-1) Step of Preparing Dispersion Liquid of Crystalline Polyester Resin Fine Particle In the step of preparing dispersion liquid of a crystalline polyester resin fine particle, a crystalline polyester resin to constitute a toner particle is synthesized and the crystalline polyester resin is dispersed in a water-based medium in a form of fine particles to prepare dispersion liquid of a crystalline polyester resin fine particle.

Examples of the method of preparing dispersion liquid of a crystalline polyester resin fine particle include a method of performing a dispersing treatment in a water-based medium without using a solvent, and a method of dissolving a crystalline polyester resin in a solvent such as ethyl acetate to obtain a solution, emulsifying and dispersing the solution in a water-based medium using a dispersing machine, and then performing a desolvation treatment.

In the present invention, "water-based medium" means a solvent containing at least 50% by mass of water. Examples of a component other than water include an organic solvent which can be dissolved in water. Examples thereof include methanol, ethanol, isopropanol, butanol, acetone, methyl-ethyl ketone, dimethyl formamide, methyl cellosolve, and tetrahydrofuran. Among these solvents, it is preferable to use an alcohol-based organic solvent which does not dissolve a resin, such as methanol, ethanol, isopropanol, or butanol. Preferably, only water is used as a water-based medium.

When a hybrid resin is used, a crystalline polyester resin unit may contain a carboxyl group. In this case, ammonia, sodium hydroxide, or the like maybe added, in order to cause ionic dissociation of a carboxyl group contained in the unit, generate a stable emulsion in a water phase, and make emulsification proceed smoothly.

A dispersion stabilizer maybe dissolved in a water-based medium. A surfactant, a resin fine particle, or the like may be added thereto in order to improve dispersion stability of an oil droplet.

Examples of the surfactant include a known anionic surfactant, cationic surfactant, non-ionic surfactant, and amphoteric surfactant.

Examples of the resin fine particle for improving dispersion stability include a methyl polymethacrylate resin fine particle, a polystyrene resin fine particle, and a polystyrene-acrylonitrile resin fine particle.

The above dispersing treatment can be performed using mechanical energy. The dispersing machine is not particularly limited. Examples thereof include a homogenizer, a low-speed shearing type dispersing machine, a high-speed shearing type dispersing machine, a friction type dispersing machine, a high-pressure jet type dispersing machine, an ultrasonic dispersing machine, and a high-pressure impact type dispersing machine ULTIMIZER.

The particle diameter of the crystalline polyester resin fine particle (oil droplet) in the dispersion liquid of crystalline polyester resin fine particle prepared in this way is preferably from 60 to 1000 nm, and more preferably from 80 to 500 nm in terms of a median diameter based on volume. This volume average particle diameter of the oil droplet can be controlled by a magnitude of mechanical energy at the time of emulsification dispersion, or the like.

The content of the crystalline polyester resin fine particle in the dispersion liquid of crystalline polyester resin fine particle is preferably from 10 to 50% by mass, and more preferably from 15 to 40% by mass relative to 100% by mass of the dispersion. By the content within such a range, it is possible to suppress expansion of particle size distribution and improve a toner characteristic.

(a-2) Step of Preparing Dispersion Liquid of Amorphous Resin Fine Particle

In the step of preparing dispersion liquid of an amorphous resin fine particle, an amorphous resin to constitute a toner particle is synthesized, and the amorphous resin is dispersed in a water-based medium in a form of fine particles to prepare dispersion liquid of an amorphous resin fine particle.

A method of preparing an amorphous resin has been described above, and therefore detailed description thereof will be omitted.

A method of dispersing an amorphous resin in a water-based medium include method (I) of forming an amorphous resin fine particle from a monomer for obtaining an amorphous resin and preparing a water-based dispersion liquid of the amorphous resin fine particle, and method (II) of preparing an oil phase liquid by dissolving or dispersing an amorphous resin in an organic solvent, dispersing the oil phase liquid in a water-based medium by phase-transfer emulsification or the like, forming an oil droplet which has been controlled so as to have a desired particle diameter, and then removing the organic solvent.

In method (I), first, a monomer for obtaining an amorphous resin is added to a water-based medium together with a polymerization initiator, and is polymerized to obtain a basic particle. Subsequently, preferably, a radical polymerizable monomer for obtaining an amorphous resin and a polymerization initiator are added to the dispersion liquid in which the resin fine particles are dispersed, and the radical polymerizable monomer is subjected to seed polymerization to the basic particle.

At this time, a water-soluble polymerization initiator can be used as the polymerization initiator. Preferable examples of the water-soluble polymerization initiator include a water-soluble radical polymerization initiator such as potassium persulfate or ammonium persulfate.

For a seed polymerization reaction system for obtaining an amorphous resin fine particle, a generally used chain transfer agent can be used in order to adjust a molecular weight of an amorphous resin. Examples of the chain transfer agent include a mercaptan such as octyl mercaptan, dodecyl mercaptan, or t-dodecyl mercaptan; a mercaptopropionic acid such as n-octyl-3-mercaptopropionate or stearyl-3-mercaptopropionate; and a styrene dimer.

In method (II), as the organic solvent used for preparing an oil phase liquid, as in the above, a solvent having a low boiling point and a low solubility in water is preferable from a viewpoint of easily removing a solvent after an oil droplet is formed. Specific examples thereof include methyl acetate, ethyl acetate, methylethylketone, isopropyl alcohol, methylisobutyl ketone, toluene, and xylene. These solvents can be used singly or in combination of two or more kinds thereof.

The use amount of an organic solvent (when two or more kinds are used, the total amount thereof) is usually from 10 to 500 parts by mass, preferably from 100 to 450 parts by mass, and more preferably from 200 to 400 parts by mass, relative to 100 parts by mass of an amorphous resin.

The use amount of a water-based medium is preferably from 50 to 2,000 parts by mass, and more preferably from 100 to 1,000 parts by mass, relative to 100 parts by mass of an oil phase liquid. By the use amount of a water-based medium within the above range, an oil phase liquid can be emulsified and dispersed in the water-based medium so as to have a desired particle diameter.

A dispersion stabilizer maybe dissolved in a water-based medium as in the above. A surfactant, a resin fine particle, or the like may be added in order to improve dispersion stability of an oil droplet. Such emulsification dispersion of an oil phase liquid can be performed using mechanical energy as in the above. The dispersing machine for performing emulsification dispersion is not particularly limited, and the machines described in the above (a-1) can be used.

After an oil droplet is formed, an organic solvent can be removed by gradually raising the temperature of a whole dispersion liquid in which amorphous resin fine particles are dispersed in a water-based medium while being stirred, stirring the dispersion liquid strongly in a certain temperature region, and then removing an solvent, or the like. Alternatively, an organic solvent can be removed by reducing the pressure using an apparatus such as an evaporator.

The particle diameter of the amorphous resin fine particle (oil droplet) in dispersion liquid of the amorphous resin fine particle prepared in method (I) or (II) above is preferably from 60 to 1000 nm, and more preferably from 80 to 500 nm in terms of a median diameter based on volume. This volume average particle diameter of the oil droplet can be controlled by a magnitude of mechanical energy at the time of emulsification dispersion, or the like.

The content of the amorphous resin fine particle in dispersion liquid of the amorphous resin fine particle is preferably from 5 to 50% by mass, and more preferably from 10 to 30% by mass. By the content within such a range, it is possible to suppress expansion of particle size distribution and improve a toner characteristic.

(a-3) Step of Preparing Dispersion Liquid of Colorant/Step of Preparing Dispersion Liquid of Release Agent Fine Particle In the step of preparing dispersion liquid of colorant, dispersion liquid of a colorant fine particle is prepared by dispersing a colorant in a water-based medium in a form of fine particles. The step of preparing dispersion liquid of a release agent fine particle is performed, if necessary, when a toner particle containing a release agent is desired. In the step, dispersion liquid of a release agent fine particle is prepared by dispersing a release agent in a water-based medium in a form of fine particles.

The water-based medium is the same as those in the above (a-1). A surfactant, a resin fine particle, or the like may be added thereto in order to improve dispersion stability.

Dispersion of a colorant/release agent can be performed using mechanical energy. The dispersing machine therefor is not particularly limited, and the machines described in the above (a-1) can be used.

As the fine particle dispersion liquid containing a release agent, fine particle dispersion liquid containing a resin in addition to a release agent, or a fine particle dispersion liquid containing only a release agent may be used. Therefore, for example, a release agent may be dispersed together with an amorphous resin fine particle to obtain a fine particle dispersion liquid containing the amorphous resin fine particle and the release agent. It is preferable to obtain a fine particle dispersion liquid containing an amorphous resin fine particle and a release agent in the following manner. That is, for example, when dispersion liquid of an amorphous resin fine particle is prepared by method (I) above, a basic particle including a monomer for obtaining an amorphous resin is obtained, and a release agent is added simultaneously when a radical polymerizable monomer and a polymerization initiator for further polymerizing to the basic particle are added. Such a fine particle dispersion liquid containing a release agent is also referred to as an "amorphous resin fine particle dispersion liquid containing a release agent".

The content of a colorant in a dispersion liquid of colorant is preferably from 10 to 50% by mass, and more preferably from 15 to 40% by mass . By the content within such a range, color reproducibility is secured. The content of a release agent fine particle in dispersion liquid of a release agent fine particle is preferably from 10 to 50% by mass, and more preferably from 15 to 40% by mass. By the content within such a range, hot offset is prevented, and a separating property is secured.

(b) Agglomerating and Fusing Step

In this agglomerating and fusing step, the above described crystalline polyester resin fine particle and amorphous resin fine particle, and a colorant particle and/or a release agent fine particle, if necessary, are agglomerated and fused simultaneously in a water-based medium to obtain a binder resin.

In this step, it is preferable to adjust an amount of each dispersion liquid so that a content ratio of each of the crystalline polyester resin and the amorphous resin in a binder resin is within the preferable range described above.

Specifically, dispersion liquid of the crystalline polyester resin and dispersion liquid of the amorphous resin prepared by the procedures described above are mixed with a dispersion liquid of colorant particle and/or a dispersion liquid of release agent fine particle, if necessary, and an aggregation agent such as magnesium chloride is added thereto, and particles are thereby fused with each other to form a binder resin. When the size of an agglomerated particle reaches a target size, aggregation is stopped by adding a salt such as brine.

The aggregation agent used in this step is not particularly limited. Examples thereof include a salt of a monovalent metal such as a salt of an alkali metal such as sodium, potassium, or lithium; a salt of a divalent metal such as calcium, magnesium, manganese, or copper; and a salt of a trivalent metal such as iron or aluminum. Specific examples of the salt include sodium chloride, potassium chloride, lithium chloride, calcium chloride, magnesium chloride, zinc chloride, copper sulfate, magnesium sulfate, and manganese sulfate. Among these salts, a salt of a divalent metal is particularly preferable. When a salt of a divalent metal is used, the aggregation can progress by smaller amount of salt. These aggregation agents can be used singly or in combination of two or more kinds thereof.

In an aggregation step, it is preferable that a time period during which dispersion liquid is allowed to stand after an addition of aggregation agent (time before heating is started) is set as short as possible. It is, accordingly, preferable that after the aggregation agent is added, the heating of the dispersion liquid for the aggregation is started as fast as possible and the dispersion is heated to a temperature equal to or higher than the glass transition temperature of a crystalline polyester resin or an amorphous resin as fast as possible.

In the aggregation step, after an aggregation agent is added, it is preferable to fast raise the temperature by heating, and the temperature rising rate is preferably 0.5° C./min or more. The upper limit of the temperature rising rate is not particularly limited, but is preferably 15° C./min or less from a viewpoint of suppressing generation of a coarse particle due to rapid progress of fusing. Furthermore, after the temperature of the dispersion liquid for aggregation reaches the glass transition temperature or higher, it is important to continue fusing by holding the temperature of the dispersion liquid for aggregation for a certain period of time, preferably until the median diameter based on volume becomes from 4.5 to 7 μm (first aging step). It is preferable to measure an average circularity of particles during aging and perform the first aging step until the average circularity becomes preferably from 0.920 to 1.000.

The temperature during fusing is preferably within a range of Tm1±15° C., more preferably within a range of Tm1 ±10° C., compared to a melting point Tm1 of a crystalline polyester resin. By the temperature within this range, a toner particle is not softened, and has a heat-resistant storage property is improved. In addition, dispersed particles of a raw material are agglomerated uniformly, a charged amount distribution becomes sharp, and an image quality is improved.

In order to obtain a binder resin having a core-shell structure, in the first aging step, a water-based dispersion liquid of a resin (preferably, the above amorphous resin) for forming a shell part is further added, and the resin for forming a shell part is agglomerated and fused to a surface of the binder resin particle (core particle) having a single layer structure, obtained above. A binder resin having a core-shell structure is thereby obtained (shell-forming step). In this case, following the shell-forming step, that the heat treatment of the reaction system is continued until the shell is aggregated and fused more strongly to the core particle surface and the desired shape of the particles is obtained (second aging step). The second aging step is preferably continued until the average circularity of the toner particles having the core-shell structure reaches the desired range of the average circularity described above.

(c) Cooling Step

In this cooling step, the dispersion liquid of the toner particle is cooled. The cooling rate in a cooling treatment is not particularly limited, but is preferably from 0.2 to 20° C./min. A method of the cooling treatment is not particularly limited. Examples thereof include a method of cooling by introducing a refrigerant from the outside of a reaction vessel and a method of cooling by introducing cool water directly into a reaction system.

(d) Filtering, Washing, and Drying Step

In a filtering step, a toner particle is filtered out from a dispersion liquid of the toner particle. Examples of a method of a filtering treatment include a centrifugation method, a method of filtering under reduced pressure using a Nutsche or the like, and a method of filtering using a filter press or the like, without any particular limitation.

Subsequently, an adhering substance such as a surfactant or an aggregation agent is removed from a toner particle (cake-like assembly) filtered out by washing in a washing step. In the washing treatment, washing is performed with water until the conductivity of a filtrate reaches, for example, a level of 5 to 10 μS/cm.

In a drying step, the toner particle, which has been wash-treated, is subjected to a drying treatment. Examples of a dryer used in this drying step include a known dryer such as a spray dryer, a vacuum freeze dryer, or a reduced pressure dryer. It is also possible to use a static tray dryer, a moving tray dryer, a fluidized layer dryer, a rotary dryer, a stirring dryer, or the like. The water content of the dried toner particle is preferably 5% by mass or less, and more preferably 2% by mass or less.

When the dried toner particles are agglomerated due to a weak interparticle attractive force, the toner particles may be subjected to a cracking treatment.

(e) Step of Treatment with External Additive

In this step, an external additive is added to a surface of the dried toner particle if necessary, and the external additive and the dried toner are mixed to manufacture a toner. The addition of an external additive improves fluidity or a charging property of a toner and improves a cleaning property, for example.

Examples of a mixing apparatus of an external additive include various known mixing apparatuses such as a Turbula mixer, a HENSCHEL MIXER, a NAUTA MIXER, or a V-type mixer. For example, when a HENSCHEL MIXER is used, stirring and mixing are preferably performed at a peripheral speed of a tip of a stirring blade of 30 to 80 m/sec at 20 to 50° C. for about 10 to 30 minutes.

<Toner>

The volume average particle diameter of the toner according to an aspect of the present invention is preferably from 3 to 10 μm, more preferably from 4 to 8 μm. By the toner within this range, a toner particle having a large adhesion, which causes fixation offset in which the particle fly and adhere to a heating member upon the fixation, is reduced, a transfer efficiency is increased, an image quality of half tone is improved, and an image quality of a thin line, a dot, or the like is improved. Toner fluidity can be also secured. It is possible to control a volume average particle diameter of a toner by a concentration of an aggregation agent, an addition amount of a solvent, and fusing time in an aggregation and fusing step in manufacturing a toner, and a composition of a binder resin.

The average circularity of the toner according to an aspect of the present invention is preferably from 0.920 to 1.000 from a viewpoint of the improvement of the transfer efficiency. For example, the average circularity can be measured using a measuring apparatus of an average circularity "FPIA-2100" (manufactured by Sysmex Corporation).

The average circularity of the toner particle can be controlled by controlling the temperature, time, or the like in the aging treatment in the above manufacturing method.

[Developer]

The color developer according to an aspect of the present invention can be obtained by mixing the above first carrier and the above color toner. The white developer according to an aspect of the present invention can be manufactured by mixing the above second carrier and a toner particle using a mixing apparatus.

Examples of the mixing apparatus include a HENSCHEL MIXER, a NAUTA MIXER, and a V-tvpe mixer. The mixing amount of a toner particle is preferably from 1 to 10% by mass relative to the total amount of the developer.

[Electrostatic Charge Image Developer Set]

The electrostatic charge image developer set according to an aspect of the present invention includes a color developer containing at least one color toner selected from the group consisting of a yellow toner, a magenta toner, and a cyan toner and a first carrier, and a white developer containing a white toner containing at least titanium oxide as a pigment and a second carrier, wherein the following formula (1) is satisfied wherein Ic (μA) is a dynamic current value of the first carrier at 100 V and Iw (μA) is a dynamic current value of the second carrier at 100 V.

[Numerical formula 6]

$$Iw<Ic \quad (1)$$

The electrostatic charge image developer set is used in an image forming apparatus having a plurality of developing machines, and forms a color toner image and a white toner image. By using the electrostatic charge image developer set having such a structure, the transfer efficiency of a color toner onto a recording medium can be the same as that of a white toner, transfer unevenness is suppressed, and image unevenness on the recording medium can be suppressed.

[Image Forming Apparatus]

The image forming method according to an aspect of the present invention can be performed using various known electrophotographic image forming apparatuses having a plurality of developing machines. For example, in a full color image forming method, it is possible to use any image forming apparatus such as a four-cycle type image forming apparatus including four kinds of color developing apparatuses for yellow, magenta, cyan, and black and one electrostatic latent image carrier (also referred to as "electrophotographic photoreceptor" or simply referred to as "photoreceptor") or a tandem type image forming apparatus equipped with an image forming unit having a color developing apparatus for each color and an electrostatic latent image carrier, for each color.

That is, the present invention provides an image forming apparatus including the electrostatic charge image developer set according to an aspect of the present invention and a plurality of developing machines.

Hereinafter, as an example of the image forming apparatus according to an aspect of the present invention, which has a plurality of developing machines and forms a color toner image and a white toner image, a tandem type image forming apparatus will be described with reference to the drawings. Here, as an example, a form in which a white toner image is formed under a color toner image will be described. However, a white toner image can be formed on a color toner image by changing a position of a developing machine.

Figure 2:
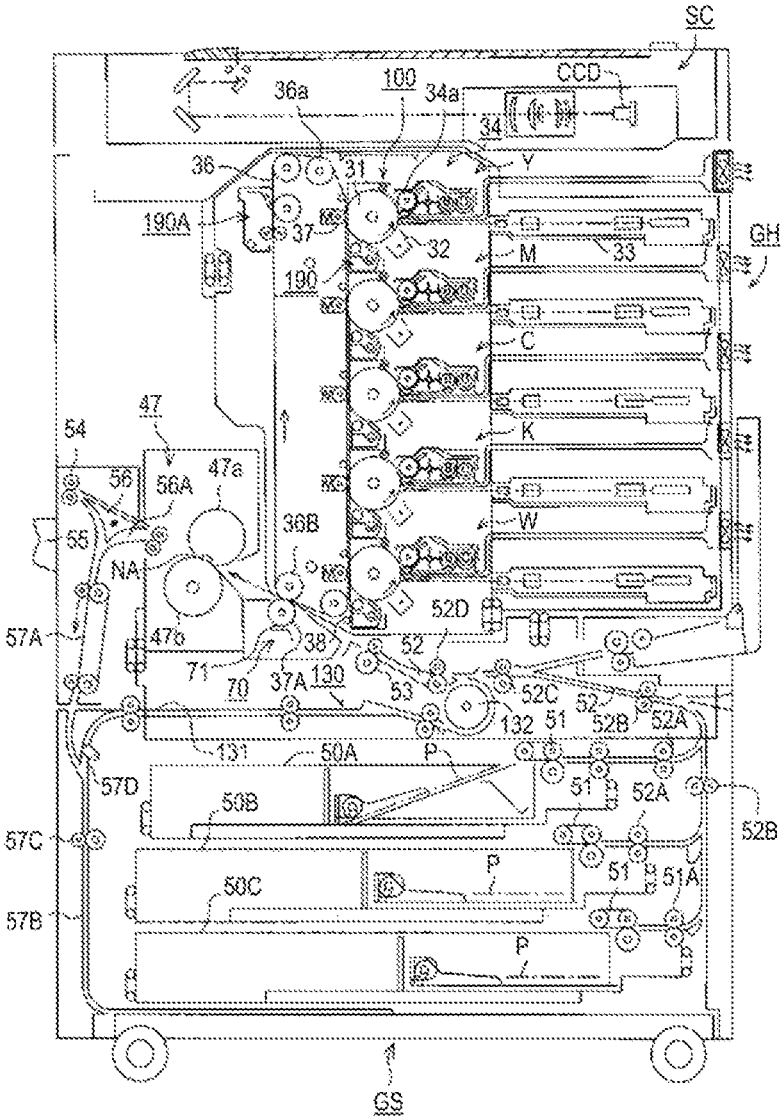
FIG. 2 is a schematic cross sectional view illustrating an example of an image forming apparatus used in the image forming method of the present invention; reference sign 31 represents photoreceptor drum, reference sign 32 represents charging unit, reference sign 33 represents exposure optical system as an image writing means, reference sign 34 represents developing apparatus, reference sign 34*a* represents developing roller, reference sign 36 represents intermediate transfer body, reference sign 36*a* represents tension roller, reference sign 36B represents backup roller, reference sign 37 represents primary transfer roller, reference sign 37A represents secondary transfer member, reference sign 38 represents detection sensor, reference sign 47 represents fixing apparatus, reference sign 47*a* represents heating roller, reference sign 47*b* represents pressurizing belt, reference signs 50A, 50B and 50C represent paper feeding cassettes, reference sign 51 represents sending roller, reference sign 52 represents conveying path, reference sign 52A represents feeding roller, reference signs 52B, 52C and 52D represent conveying rollers, reference sign 53 represents resist roller, reference sign 54 represents paper ejecting roller, reference sign 55 represents paper ejecting tray, reference sign 56 represents switching member of ejected paper, reference sign 56A represents sheet guiding portion, reference sign 57A represents conveying mechanism, reference sign 57B represents conveying path, reference sign 57C represents sheet inverting portion, reference sign 57D represents branch part, reference sign 70 represents secondary transfer apparatus, reference sign 71 represents cleaning blade, reference sign 100 represents process unit of each color of yellow (Y), magenta (M), cyan (C), black (K), and white (W), reference sign 130 represents feeding unit for dual face copy, reference sign 131 represents conveying guide, reference sign 132 represents feeding roller, reference sign 190 represents photoreceptor cleaning apparatus as a means for cleaning an image carrier, reference sign 190A represents intermediate transfer body cleaning apparatus, reference sign GS represents image forming apparatus, reference sign GH represents image forming apparatus body, reference sign SC represents image reading apparatus, reference sign CCD represents line image sensor, reference sign NA represents nip, and reference sign P represents image support.

FIG. 2 is a schematic cross sectional view illustrating an example of a color image forming apparatus used in the image forming method according to an aspect of the present invention. In FIG. 2, as color toners, four kinds of toners YMC and K are used, and a white toner (W) is used in addition.

First, an outline of an image forming apparatus for color electrophotography, equipped with a detection sensor and a secondary transfer apparatus, will be described.

An image forming apparatus GS is referred to as a tandem type color image forming apparatus. In the image forming apparatus GS, image forming units to form color toner images of yellow, magenta, cyan, and black and a white toner image are disposed along a moving direction of an intermediate transfer body 36. A color toner image and a white toner image formed on an image carrier of each image forming unit are multiply transferred onto an intermediate transfer body and are superimposed, and then are transferred onto an image support collectively.

In FIG. 2, a document image placed on an image reading apparatus SC disposed in an upper portion of the image forming apparatus GS is scanned and exposed by an optical system, and is read by a line image sensor CCD. An analog signal photoelectrically converted by the line image sensor CCD is subjected to analog processing, A/D conversion, shading compensation, image compression processing, or the like in an image processing unit. Thereafter, an image data signal is sent to an exposure optical system 33 as an image writing means.

Examples of the intermediate transfer body 36 include a drum type and an endless belt type, and these have a similar function to each other. However, hereinafter, an intermediate transfer body means an endless belt type intermediate transfer body 36.

In FIG. 2, five pairs of process units 100 are disposed for forming images for each color of yellow (Y), magenta (M), cyan (C), black (K), and white (W) in a peripheral portion of the intermediate transfer body 36. The process units 100 are longitudinally disposed in a vertical direction along the intermediate transfer body 36 with respect to a rotational direction of the intermediate transfer body 36 in a vertical direction illustrated by an arrow in FIG. 2 as a means for forming a color toner image and a white toner image, and are disposed in the order of Y, M, C, K, and W.

The five pairs of process units 100 have a common structure, and each include a photoreceptor drum 31, a charging unit 32 as a charging means, the exposure optical system 33 as an image writing means, a developing apparatus (developing machine) 34, and a photoreceptor cleaning apparatus 190 as a means for cleaning an image carrier.

For example, the photoreceptor drum 31 is obtained by forming a photosensitive layer having a layer thickness (film thickness) of about 20 to 40 μm in an outer periphery of a cylindrical substrate formed of a metal material such as aluminum, having an outer diameter of about 40 to 100 mm. The photoreceptor drum 31 is rotated in the arrow direction by power from a driving source (not illustrated) while the substrate is grounded, for example, at a linear velocity of about 80 to 280 mm/s, preferably of 220 mm/s.

Around the photoreceptor drum 31, an image forming unit including a set of the charging unit 32 as a charging means, the exposure optical system 33 as an image writing means, and a developing apparatus (developing machine) 34 is disposed with respect to a rotational direction of the photoreceptor drum 31 illustrated by an arrow in FIG. 2.

The charging unit 32 as a charging means is disposed so as to face the photoreceptor drum 31 and come close thereto in a direction parallel to a rotational axis of the photoreceptor drum 31. The charging unit 32 includes a discharging wire as a corona discharge electrode which gives a predetermined potential to the photosensitive layer of the photoreceptor drum 31. The charging unit 32 performs charging (minus charging in this embodiment) by corona discharge having the same polarity as a toner, and gives a potential to the photoreceptor drum 31 uniformly.

The exposure optical system 33 as an image writing means makes laser light emitted from a semiconductor laser (LD) light source (not illustrated) perform rotary scanning in a main scanning direction with a rotary polygon mirror (no reference sign), performs exposure (image writing) on the photoreceptor drum 31 with an electrical signal corresponding to an image signal via a fθ lens (no reference sign), a reflection mirror (no reference sign), or the like, and forms an electrostatic latent image with corresponding to a document image on the photosensitive layer of the photoreceptor drum 31.

The developing apparatus 34 as a developing means houses a two-component developer of each color of yellow (Y), magenta (M), cyan (C), black (K), and white (W), charged so as to have the same polarity as the charging polarity of the photoreceptor drum 31. For example, the developing apparatus 34 includes a developing roller **34*a* which is a developer carrier formed of a cylindrical non-magnetic stainless or aluminum material, having a thickness of 0.5 to 1 mm and an outer diameter of 15 to 25 mm. The developing roller 34*a* is kept in non-contact with the photoreceptor drum 31 with a predetermined gap, for example, a gap of 100 to 1000 μm by an abutting roll (not illustrated), and is rotated in the same direction as the rotational direction of the photoreceptor drum 31. In developing, by applying a direct current voltage having the same polarity as a toner (minus polarity in this embodiment) or a developing bias voltage to superimpose an alternating current voltage to a direct current voltage to the developing roller 34*a*, reversal development is performed to an exposed part on the photoreceptor drum 31**.

For the intermediate transfer body 36, a semiconductive endless (seamless) resin belt having a volume resistivity of about $1.0\times10^{7}$ to $1.0\times10^{9}$ Ω·cm and a surface resistivity of about $1.0\times10^{10}$ to $1.0\times10^{12}$Ω/□ is used. As the resin belt, it is possible to use a semiconductive resin film having a thickness of 0.05 to 0.5 mm, obtained by dispersing a conductive material in an engineering plastic such as a modified polyimide, a thermosetting polyimide, an ethylene tetrafluoroethylene copolymer, polyvinylidene fluoride, or a nylon alloy. In addition, as the intermediate transfer body 36, it is possible to use a semiconductive rubber belt having a thickness of 0.5 to 2.0 mm, obtained by dispersing a conductive material in silicone rubber, urethane rubber, or the like. The intermediate transfer body 36 is wound by a plurality of rollers including a tension roller **36*a* and a backup roller 36**B facing a secondary transfer member, and is rotatably supported in the vertical direction.

For example, a primary transfer roller 37 as a first transfer means for each color is formed of a roller-like conductive material using silicone or foamed rubber such as urethane, is disposed so as to face the photoreceptor drum 31 for each color with the intermediate transfer body 36 therebetween, and presses a back surface of the intermediate transfer body 36 to form a transfer region between the intermediate transfer body 36 and the photoreceptor drum 31. A direct current constant current having a polarity (plus polarity in this embodiment) opposite to a toner is applied to the primary transfer roller 37 by constant current control. A toner image on the photoreceptor drum 31 is transferred onto the intermediate transfer body 36 by a transfer electric field formed in the transfer region.

The toner image transferred onto the intermediate transfer body 36 is transferred onto an image support P. A detection sensor 38 for measuring a concentration of a patch image toner is disposed on a periphery of the intermediate transfer body 36.

A cleaning apparatus 190A is disposed in order to clean a remaining toner on the intermediate transfer body 36.

Additionally, a secondary transfer apparatus 70 is disposed in order to clean a patch image toner on a secondary transfer member 37A.

Next, an image forming method (image forming step or process) will be described.

By start of a photoreceptor driving motor (not illustrated) due to start of image recording, the photoreceptor drum 31 of yellow (Y) is rotated in a direction illustrated by an arrow in FIG. 2, and a potential is given to the photoreceptor drum 31 of Y by the charging unit 32 of Y. After a potential is given to the photoreceptor drum 31 of Y, the exposure optical system 33 of Y performs exposure (image writing)

with a first color signal, that is, an electrical signal corresponding to image data of Y. An electrostatic latent image corresponding to an image of yellow (Y) is formed on the photoreceptor drum 31 of Y. This latent image is subjected to reversal development by the developing apparatus 34 of Y, and a toner image formed of a toner of yellow (Y) is formed on the photoreceptor drum 31 of Y. The toner image of Y formed on the photoreceptor drum 31 of Y is transferred onto the intermediate transfer body 36 by the primary transfer roller 37 as a primary transfer means.

Subsequently, a potential is given to the photoreceptor drum 31 of M by the charging unit 32 of magenta (M). After a potential is given to the photoreceptor drum 31 of M, the exposure optical system 33 of M performs exposure (image writing) with a first color signal, that is, an electrical signal corresponding to image data of M. An electrostatic latent image corresponding to an image of magenta (M) is formed on the photoreceptor drum 31 of M. This latent image is subjected to reversal development by the developing apparatus 34 of M, and a toner image formed of a toner of magenta (M) is formed on the photoreceptor drum 31 of M. The toner image of M formed on the photoreceptor drum 31 of M is superimposed on the toner image of Y and transferred onto the intermediate transfer body 36 by the primary transfer roller 37 as a primary transfer means.

By a similar process, a toner image formed of a toner of cyan (C) formed on the photoreceptor drum 31 of cyan (C) and a toner image formed of a toner of black (K) formed on the photoreceptor drum 31 of black (K) are superimposed and formed on the intermediate transfer body 36 in order. A superimposed color toner image formed of toners of Y, M, C, and K is formed on a peripheral surface of the intermediate transfer body 36.

Subsequently, the photoreceptor drum 31 of white (W) is rotated in a direction illustrated by an arrow in FIG. 2, and a potential is given to the photoreceptor drum 31 of W by the charging unit 32 of W. After a potential is given to the photoreceptor drum 31 of W, the exposure optical system 33 of W performs exposure (image writing) with a first color signal, that is, an electrical signal corresponding to image data of W. An electrostatic latent image corresponding to an image of white (W) is formed on the photoreceptor drum of W. This latent image is subjected to reversal development by the developing apparatus 34 of W, and a toner image formed of a toner of white (W) is formed on the photoreceptor drum 31 of W. The toner image of W formed on the photoreceptor drum 31 of W is transferred onto the intermediate transfer body 36 by the primary transfer roller 37 as a primary transfer means. In this way, a superimposed color toner image formed of toners of Y, M, C, and K is formed on a peripheral surface of the intermediate transfer body 36, and a white toner image formed of a toner of W is formed on the color toner image.

A toner remaining on a peripheral surface of each photoreceptor drum 31 after transfer is cleaned by the photoreceptor cleaning apparatus 190.

Meanwhile, the image support Pas recording paper, housed in each of paper feeding cassettes 50A, 50B, and 50C, is fed by a sending roller 51 and a feeding roller 52A disposed in each of the paper feeding cassettes 50A, 50B, and 50C. The image support P is conveyed on a conveying path 52 by conveying rollers 52B, 52C, and 52D, passes through a resist roller 53, and is conveyed to the secondary transfer member 37A as a secondary transfer means to which a voltage having a polarity opposite to a toner (plus polarity in this embodiment) is applied. In a transfer region of the secondary transfer member 37A, a superimposed color toner image (color image) formed on the intermediate transfer body 36 and a white toner image on the color toner image (color image) are transferred onto the image support P collectively. In this way, an image is formed on a white toner layer with a color toner.

The image support P in which a color image has been transferred on a white toner layer is heated, pressurized, and fixed in a nip formed of a heating roller 47*a* and a pressurizing belt 47*b* of a fixing apparatus 47, is held by a paper ejecting roller 54, and is placed on a paper ejecting tray 55 outside the machine.

After a white toner layer and a color image are transferred onto the image support P by the secondary transfer member 37A as a secondary transfer means, a toner remaining on the intermediate transfer body 36 from which the image support P has been separated curvedly is removed by the intermediate transfer body cleaning apparatus 190A.

A patch image toner on the secondary transfer member 37A is cleaned by a cleaning blade 71 of the secondary transfer apparatus 70.

As described above, in the image forming method using the image forming apparatus (developing machine) having the electrostatic charge image developer set including a color developer and a white developer, according to an aspect of the present invention, the formula Iw<Ic is satisfied wherein Ic (μA) is a dynamic current value of a first carrier contained in a color developer at 100 V and Iw (μA) is a dynamic current value of a second carrier contained in a white developer used for forming a white toner image at 100 V. In this way, the transfer efficiency of a color toner onto a recording medium can be the same as that of a white toner, transfer unevenness is suppressed, and image unevenness on the recording medium can be suppressed.

EXAMPLE

Next, an effect of the present invention will be described using the following Examples and Comparative Examples. However, the technical scope of the present invention is not limited only to the following Examples. The weight average molecular weight (Mw) and the number average molecular weight (Mn) of each of a binder resin and a coating resin was measured under the following measuring conditions.

<Measuring Conditions>

Used apparatus HLC-8220 (manufactured by Tosoh Corporation)

Column: TSKGUARDCOLUMN/TSKGEL SUPER-HZMM (three-continuous type) (manufactured by Tosoh Corporation)

Column temperature: 40° C.

Mobile phase: tetrahydrofuran

Flow rate: 0.2 ml/min

Injection amount: 10 μl

Detector: retractive index detector (IR detector)

<Manufacturing Toner Particle>

<<Synthesis of Hybrid Crystalline Polyester Resin (c1)>>

The following raw material monomers of an addition polymerization-type resin (styrene-acrylic resin: StAc) unit including an amphoteric reactive monomer and a radical polymerization initiator were put into a dropping funnel.

Styrene 34 parts by mass n-butyl acrylate 12 parts by mass

Acrylic acid 2 parts by mass

Polymerization initiator (di-t-butylperoxide) 7 parts by mass

The following raw material monomers of a polycondensation-type resin (crystalline polyester resin CPEs) unit were put into a four neck flask equipped with a nitrogen introducing tube, a dewatering tube, a stirrer, and a thermocouple, and were heated to 170° C. to be dissolved.

Sebacic acid 369 parts by mass 1,10-decane diol 318 parts by mass

Subsequently, the raw material monomers of an addition polymerization-type resin (StAc) were added dropwise over 90 minutes while being stirred, were aged for 60 minutes, and then unreactive addition polymerization monomers were removed under reduced pressure (8 kPa). An amount of monomers removed at this time was very small relative to the above raw material monomer ratio of the resin.

Subsequently, the resulting mixture was cooled to 200° C., and then reacted under reduced pressure (20 kPa) for one hour. A hybrid crystalline polyester resin (c1) was thereby obtained. The hybrid crystalline polyester resin (c1) contained 6.5% by mass of the resin (StAc) unit other than CPEs relative to the total amount thereof, and had a form in which CPEs are grafted to StAc. The number average molecular weight (Mn) of the hybrid crystalline polyester resin (c1) was 9,000, and the melting point (Tc) thereof was 76° C.

<<Preparation of water-based dispersion liquid (C1) of hybrid crystaline polyester resin (c1)>>

30 parts by mass of the hybrid crystalline polyester resin (c1) obtained as above was melted and fed to an emulsification dispersion machine "CAVITRON CD1010" (manufactured by EUROTEC LIMITED) at a feeding rate of 100 parts by mass/min while being melted. At the same time as this feeding of the hybrid crystalline polyester resin (c1) in a melted state, diluted ammonia water having a concentration of 0.37% by mass obtained diluting 70 parts by mass of reagent ammonia water with ion-exchanged water in an aqueous solvent tank was fed to the emulsification dispersion machine at a feeding rate of 0.1 L/min. while being heated to 100° C. by a heat exchanger. By operating this emulsification dispersion machine under the conditions of a rotational Speed of a rotor of 60 Hz and a pressure of 5 kg/cm$^2$, a water-based dispersion liquid (C1) of the hybrid crystalline polyester resin (c1) fine particle having a solid content of 30 parts by mass was prepared. The median diameter based on volume of the hybrid crystalline polyester resin (c1) particle contained in this water-based dispersion liquid (C1) was 230 nm.

<<Synthesis of Crystalline Polyester Resin (c2)>>

The following raw material monomers of a polycondensation-type resin (crystalline polyester resin CPEs) were put into a four neck flask equipped with a nitrogen introducing tube, a dewatering tube, a stirrer, and a thermocouple, and were heated to 170° C. to be dissolved.

Sebacic acid 369 parts by mass 1,10-decane diol 318 parts by mass

Thereafter, 0.8 parts by mass of $Ti(OBu)_4$ was added as an esterification catalyst. The resulting mixture was heated to 235° C., was reacted under normal pressure (101.3 kPa) for five hours, and was further reacted under reduced pressure (8 kPa) for one hour.

Subsequently, the resulting mixture was cooled to 200° C., and then reacted under reduced pressure (20 kPa) for one hour. A crystalline polyester resin (c2) was thereby obtained. The number average molecular weight (Mn) of the crystalline polyester resin (c2) was 9,000, the melting point (Tc) thereof was 76° C., and the acid value thereof was 7 mgKOH/g.

<<Preparation of Water-Based Dispersion Liquid (C2) of Crystalline Polyester Resin (c2)>>

A water-based dispersion liquid (C2) of the crystalline polyester resin (c2) was prepared in a similar manner to the <<Preparation of water-based dispersion liquid (C1) of hybrid crystalline polyester resin (c1)>> except that the crystalline polyester resin (c2) obtained above was used in place of the hybrid crystalline polyester resin (c1). The median diameter based on volume of the hybrid crystalline polyester resin (c2) particle contained in this water-based dispersion liquid (C2) was 220 nm.

<<Preparation of Water-Based Dispersion Liquid (X1) of Amorphous Resin Fine Particle>>

[First Stage Polymerization]

Into a 5 L reaction vessel equipped with a stirring apparatus, a temperature sensor, a cooling tube, and a nitrogen introducing apparatus, 8 parts by mass of sodium dodecyl sulfate and 3000 parts by mass of ion-exchanged water were added, and the internal temperature thereof was raised to 80° C. while being stirred at a stirring rate of 230 rpm in a nitrogen stream. After the temperature was raised, a solution obtained by dissolving 10 parts by mass of potassium persulfate in 200 parts by mass of ion-exchanged water was added. The liquid temperature was adjusted to 80° C. again. A monomer mixed solution containing 480 parts by mass of styrene, 250 parts by mass of n-butyl acrylate, and 68 parts by mass of methacrylic acid was dropwise added over one hour.

Thereafter, the resulting solution was heated and stirred at 80° C. for two hours and was thereby polymerized to prepare a dispersion liquid of a resin fine particle (x1).

[Second Stage Polymerization]

Into a 5 L reaction vessel equipped with a stirring apparatus, a temperature sensor, a cooling tube, and a nitrogen introducing apparatus, a solution obtained by dissolving 7 parts by mass of sodium poly(oxyethylene) (2) dodecyl ether sulfate in 3000 parts by mass of ion-exchanged water was added, and the temperature thereof was raised to 98° C. Thereafter, 260 parts by mass of the dispersion liquid of a resin fine particle (x1) and a solution obtained by dissolving monomers of 284 parts by mass of styrene (St), 92 parts by mass of n-butyl acrylate (BA), 13 parts by mass of methacrylic acid (MAA), and1.5parts by mass of n-octyl-3-mercaptopropionate, and 190 parts by mass of a release agent of behenyl behenate (melting point 73° C.) at 90° C. were added. The resulting solution was mixed and dispersed for one hour with a mechanical dispersing machine having a circulation path "CLEARMIX" (manufactured by M Technique Co., Ltd.) to prepare a dispersion containing an emulsion particle (oil droplet).

Subsequently, an initiator solution obtained by dissolving 6 parts by mass of potassium persulfate in 200 parts by mass of ion-exchanged water was added to this dispersion liquid. This system was heated and stirred for one hour at 84° C. and was thereby polymerized to prepare a dispersion liquid of a resin fine particle (x2).

[Third Stage Polymerization]

Furthermore, 400 parts by mass of ion-exchanged water was added to and well mixed with the dispersion liquid of a resin fine particle (x2). Thereafter, a solution obtained by dissolving 11 parts by mass of potassium persulfate in 400 parts by mass of ion-exchanged water was added. A monomer mixed solution containing 350 parts by mass of styrene (St), 215 parts by mass of n-butyl acrylate (BA), 30 parts by mass of acrylic acid (AA), and 8 parts by mass of n-octyl-3-mercaptopropionate was dropwise added over one hour at 82° C. After adding dropwise was terminated, the resulting solution was heated and stirred for two hours and was thereby polymerized. Thereafter, the solution was cooled to 28° C. to prepare a water-based dispersion liquid of an amorphous resin fine particle (X1).

The median diameter based on volume of an amorphous resin fine particle in the obtained water-based dispersion liquid of an amorphous resin fine particle (X1) was 220 nm. The glass transition temperature (Tg) thereof was 55° C., and the weight average molecular weight (Mw) thereof was 32,000.

<<Preparation of Water-Based Dispersion Liquid (Cy1) of a Cyan Colorant Particle>>

90 parts by mass of sodium dodecyl sulfate was added to 1600 parts by mass of ion-exchanged water. While this solution was stirred, 420 parts by mass of copper phthalocyanine (C. I. Pigment Blue 15:3) was gradually added. Subsequently, the resulting solution was subjected to a dispersion treatment using a stirring apparatus "CLEARMIX" (manufactured by M Technique Co., Ltd.) to prepare a water-based dispersion liquid of a colorant particle (Cy1).

The median diameter based on volume of a cyan colorant particle contained in the obtained water-based dispersion of a cyan colorant particle (Cy1) was 110 nm.

<<Preparation of Water-Based Dispersion Liquid (W1) of White Pigment>>

90 parts by mass of sodium dodecyl sulfate was added to 1600 parts by mass of ion-exchanged water. While this solution was stirred, 700 parts by mass of rutile type titanium oxide (manufactured by ISHIHARA SANGYO KAISHA, LTD.) was gradually added. Subsequently, the resulting solution was subjected to a dispersion treatment using a stirring apparatus "CLEARMIX" (manufactured by M Technique Co., Ltd.) to prepare a water-based dispersion liquid of a colorant particle (W1).

The median diameter based on volume of a white pigment contained in the obtained water-based dispersion liquid of a white pigment (W1) was 180 nm.

<<Manufacturing Cyan Toner Particle (1)>>

Into a reaction vessel equipped with a stirring apparatus, a temperature sensor, and a cooling tube, 288 parts by mass (in terms of solid content) of the water-based dispersion liquid of an amorphous resin fine particle (X1), 70 parts by mass (in terms of solid content) of the water-based dispersion liquid (C1) of a hybrid crystalline polyester resin fine particle, and 2000 parts by mass of ion-exchanged water were added. Thereafter, a 5 mol/L of sodium hydroxide aqueous solution was added and the pH was adjusted to 10.

Thereafter, 30 parts by mass (in terms of solid content) of the water-based dispersion liquid of a cyan colorant particle (Cy1) was added. Subsequently, a solution obtained by dissolving 60 parts by mass of magnesium chloride in 60 parts by mass of ion-exchanged water was added over 10 minutes at 30° C. while being stirred. Thereafter, the resulting solution was allowed to stand for three minutes, and then the temperature started to be raised. The temperature of this system was raised to 80° C. over 60 minutes, and a reaction of particle growth was continued while the temperature was maintained at 80° C. In this state, the particle diameter of an assembled particle was measured with a "COULTER MULTISIZER 3" (manufactured by Beckman Coulter, Inc.). When the median diameter based on volume reached 6.0 μm, a solution obtained by dissolving 190 parts by mass of sodium chloride in 760 parts by mass of ion-exchanged water was added to stop the particle growth. The temperature was further raised. By heating and stirring the solution at 90° C., fusion of a particle proceeded. When the average circularity of a toner reached 0.945, the solution was cooled to 30° C. at a cooling rate of 2.5° C/min. The average circularity was measured using a measuring apparatus "FPIA-2100" (manufactured by Sysmex Corporation) (the detection number of HPF: 4000).

Subsequently, the solution was subjected to solid-liquid separation. An operation of dispersing the dehydrated toner cake again in ion-exchanged water and subjecting the resulting solution to solid-liquid separation was repeated three times for washing. Thereafter, drying was performed at 40° C. for 24 hours to obtain a toner particle (1).

To 100 parts by mass of the obtained toner particle (1), 0.6 parts by mass of a hydrophobic silica (hydrophobicity=68) having a number average primary particle diameter of 12 nm, 1.5 parts by mass of a hydrophobic silica (hydrophobicity=60) having a number average primary particle diameter of 80 nm, and 0.5 parts by mass of hydrophobic titanium oxide (hydrophobicity=63) having a number average primary particle diameter of 20 nm were added, and were mixed by a "HENSCHEL MIXER" (manufactured by MITSUI MIIKE MACHINERY Co. Ltd.) at a peripheral speed of a rotary wing of 35 mm/sec at 32° C. for 20 minutes. Thereafter, a coarse particle was removed using a sieve having an aperture of 45 μm. By performing the above treatments with an external additive, cyan toner particle (1) having a median diameter based on volume of 6.1 μm was obtained.

<<Manufacturing White Toner Particle (1)>>

A white toner particle (1) having a median diameter based on volume of 6.1 μm was obtained in a similar manner to the above <<Manufacturing cyan toner particle (1)>> except that 90 parts by mass (in terms of solid content) of the white pigment dispersion liquid (W1) was used in place of 30 parts by mass (in terms of solid content) of the water-based dispersion liquid of a cyan colorant particle (Cy1).

<<Manufacturing Cyan Toner Particle (2)>>

A cyan toner particle (2) having a median diameter based on volume of 6.2 μm was obtained in a similar manner to the above <<Manufacturing cyan toner particle (1)>> except that 70 parts by mass (in terms of solid content) of the water-based dispersion liquid (C2) of a crystalline polyester resin fine particle was used in place of 70 parts by mass (in terms of solid content) of the water-based dispersion liquid (C1) of a hybrid crystalline polyester resin fine particle.

<<Manufacturing White Toner Particle (2)>>

A white toner particle (2) having a median diameter based on volume of 6.2 μm was obtained in a similar manner to the above <<Manufacturing white toner particle (1)>> except that 70 parts by mass (in terms of solid content) of the water-based dispersion liquid (C2) of a crystalline polyester resin fine particle was used in place of 70 parts by mass (in terms of solid content) of the water-based dispersion liquid (C1) of a hybrid crystalline polyester resin fine particle.

[Manufacturing Carrier]

<Preparation of Core Particle>

A Mn—Mg-based "ferrite particle" having a volume average particle diameter of 35 μm and a saturation magnetization of 63 $A \cdot m^2/kg$ was prepared.

<Manufacturing Coating Resin 1>

Cyclohexyl methacrylate and methyl methacrylate were added to a 0.3% by mass sodium benzenesulfonate aqueous solution at a ratio (mass ratio and copolymerization ratio) of cyclohexyl methacrylate/methyl methacrylate=50:50. Then, 0.5% by mass of ammonium peroxodisulfate relative to the total amount of the monomers was added, and the resulting solution was subjected to emulsion polymerization to manufacture a"coating resin1". The weight average molecular weight of the obtained coating resin 1 was 500,000.

<Manufacturing Coating Resin 2>

Coating resin 2 was manufactured in a similar manner to the above <Manufacturing coating resin 1> except that styrene was used in place of cyclohexyl methacrylate. The weight average molecular weight of the obtained coating resin 2 was 560,000.

(Manufacturing Carrier 1)

Into a high-speed stirring mixing machine with a horizontal rotary wing, 100 parts by mass of the "core particle" and 3.8 parts by mass of the "coating resin 1", prepared above, were added. The resulting mixture was mixed and stirred at a peripheral speed of a horizontal rotary wing of 8 m/sec at 22° C. for 15 minutes, and then mixed at 120° C. for 50 minutes. A resin coating layer was formed on a surface of the core particle by an action of a mechanical impact (mechanochemical method).

(Manufacturing Carrier 2)

Into a high-speed stirring mixing machine with a horizontal rotary wing, 100 parts by mass of the "core particle" and 3.8 parts by mass of the "coating resin 1", prepared above, and 0.19 parts by mass of carbon black (Mogul (registered trademark) L, manufactured by CABOT Corporation, average particle diameter 24 nm, volume resistance value: $1\times10^{-2}$ Ω·cm) were input. The resulting solution was mixed and stirred at a peripheral speed of a horizontal rotary wing of 8 m/sec at 22° C. for 15 minutes, and then mixed at 120° C. for 50 minutes. A resin coating layer containing carbon black was formed on a surface of the core particle by an action of a mechanical impact (mechanochemical method).

(Manufacturing Carrier 3)

A carrier 3 was manufactured in a similar manner to the above (Manufacturing carrier 2) except that the addition amount of carbon black was changed to 0.38 parts by mass.

(Manufacturing Carrier 4)

A carrier 4 was manufactured in a similar manner to the above (Manufacturing carrier 2) except that the addition amount of carbon black was changed to 0.57 parts by mass.

(Manufacturing Carrier 5)

A carrier 5 was manufactured in a similar manner to the above (Manufacturing carrier 2) except that the addition amount of carbon black was changed to 0.76 parts by mass.

(Manufacturing Carrier 6)

A carrier 6 was manufactured in a similar manner to the above (Manufacturing carrier 1) except that the "coating resin 1" was changed to "coating resin 2".

(Manufacturing Carrier 7)

A carrier 7 was manufactured in a similar manner to the above (Manufacturing carrier 3) except that the "coating resin 1" was changed to "coating resin 2".

(Manufacturing Carrier 8)

A carrier 8 was manufactured in a similar manner to the above (Manufacturing carrier 1) except that the added amount of the "coating resin 1" was changed to 1.5 parts by mass.

<Amount of Conductive Fine Particle>

The amount of a conductive fine particle (carbon black) in a resin coating layer was measured as follows. That is, 1 g of a carrier and 20 ml of toluene were added into a 100 ml sample tube, and were stirred for 30 minutes using a wave rotor at 100 rpm. A supernatant liquid was removed while the carrier was fixed to a lower part of a beaker with a magnet. This treatment was repeated three times. Thereafter, a residue was dried and the mass thereof was measured. A reduction amount from an initial mass was determined, and the amount X(g) of a coating resin containing a conductive fine particle (carbon black) was determined. Subsequently, a conductive fine particle contained in a resin coating layer was separated from the solution of the dissolved coating resin using a super high speed centrifuge apparatus. The separated conductive fine particle was dried using a dryer. The amount Y(g) of the conductive fine particle was determined, and the amount A (parts by mass) of the conductive fine particle relative to 100 parts by mass of the coating resin was determined.

$$A=\{Y/(X-Y)\}\times100 \quad \text{[Numerical formula 7]}$$

<Dynamic Current Value of Carrier>

The dynamic current value of a carrier was measured using the measuring apparatus illustrated in FIG. 1 and the following measuring method. That is, in FIG. 1, the aluminum electrode drum 11 having a diameter of 80 mmϕ was replaced with a photoreceptor drum. A magnetic brush was formed by supplying 5 g of the carrier 20 onto the developing sleeve 12. This magnetic brush was rubbed with the electrode drum 13. A voltage (100 V) was applied between the developing sleeve 12 and the electrode drum 13 with the direct current power source 14. The dynamic current value flowing between the developing sleeve 12 and the electrode drum 13 was measured using the ammeter 15. Measuring conditions are as follows.

<Conditions for Measuring Dynamic Current Value>

The number of rotations of sleeve: 100 rpm
Applied voltage: 100 V
Amount of sample: 5 g
Sleeve
Length in a longitudinal direction: 60 mm, Diameter: 37.5 mm,
Surface magnetic flux density: 1300 gauss
The number of magnet magnetic pole: 8
Aluminum electrode drum
Length in a longitudinal direction: 60 mm, Diameter: 80 mm
Width of developing nip: 1 cm
Distance between developing sleeve and drum: 0.6 mm
Environment: 20° C., 50% RH Compositions and dynamic current values of the carriers are indicated in the following Table 1.

TABLE 1

| | coating resin | amount of coating resin relative to 100 parts by mass of core particle (parts by mass) | the kind of conductive fine particle | amount of conductive fine particle relative to 100 parts by mass of resin (parts by mass) | amount of conductive fine particle relative to 100 parts by mass of core particle (parts by mass) | dynamic current value 100 V (μA) |
|---|---|---|---|---|---|---|
| carrier 1 | CHMA/MMA | 3.8 | none | 0 | 0 | 0.23 |
| carrier 2 | CHMA/MMA | 3.8 | CB | 5 | 0.19 | 0.70 |
| carrier 3 | CHMA/MMA | 3.8 | CB | 10 | 0.38 | 1.10 |
| carrier 4 | CHMA/MMA | 3.8 | CB | 15 | 0.57 | 2.00 |
| carrier 5 | CHMA/MMA | 3.8 | CB | 20 | 0.76 | 3.00 |
| carrier 6 | St/MMA | 3.8 | none | 0 | 0 | 0.25 |

TABLE 1-continued

| | coating resin | amount of coating resin relative to 100 parts by mass of core particle (parts by mass) | the kind of conductive fine particle | amount of conductive fine particle relative to 100 parts by mass of resin (parts by mass) | amount of conductive fine particle relative to 100 parts by mass of core particle (parts by mass) | dynamic current value 100 V (μA) |
|---|---|---|---|---|---|---|
| carrier 7 | St/MMA | 3.8 | CB | 10 | 0.38 | 1.30 |
| carrier 8 | CHMA/MMA | 1.5 | none | 0 | 0 | 1.20 |

<<Manufacturing Cyan Developers (Color Developers) 1 to 8>>

The cyan toner particles 1 and 2, and the carriers 1 to 5, 7, and 8, manufactured as above, were mixed in the combinations indicated in the following Table 3 such that the toner concentration was 5% by mass to manufacture cyan developers (color developers) 1 to 8. Mixing was performed at 25° C. for 30 minutes using a V-type mixer (manufactured by TOKUJU CORPORATION) as a mixing machine.

<<Manufacturing White Developers 1 to 6>>

The white toner particles 1 and 2, and the carriers 1 to 4 and 6, manufactured as above, were mixed in the combinations indicated in the following Table 2 such that the toner concentration was 5% by mass to manufacture white developers 1 to 6. Mixing was performed at 25° C. for 30 minutes using a V-type mixer (manufactured by TOKUJU CORPORATION) as a mixing machine.

<Measurement of Charged Amount (Charge Amount Per Unit Mass)>

A developer containing 1 g of a toner and 19 g of a carrier was put into a 20 cc glass bottle, and was allowed to stand in an NN environment (temperature:20° C., relative humidity: 50% RH) for 24 hours. Thereafter, the developer was shaken using a shaker "YS-LD" (manufactured by YAYOI Co. Ltd.) at a shaking angle of 45 degrees at 200 strokes/min for 20 minutes, and the toner and the carrier were charged.

The developer was disposed between parallel plate (aluminum) electrodes while being slided. When the toner was developed under the conditions of a gap between electrodes of 0.5 mm, a DC bias of 1.0 kV, an AC bias of 4.0 kV, and 2.0 kHz, the charge amount and the mass of the developed toner were measured, and a charge amount per unit mass Q/m (μC/g) was adopted as a charged amount.

Compositions and physical properties of the white developers and the cyan developers (color developers) are indicated in the following Tables 2 and 3.

TABLE 2

| | the kind of toner | the kind of carrier | Aw amount of conductive fine particle relative to 100 parts by mass of resin (parts by mass) | Iw dynamic current value 100 V (μA) | toner charged amount (μC/g) |
|---|---|---|---|---|---|
| white developer 1 | white toner 1 | carrier 1 | 0 | 0.23 | 50 |
| white developer 2 | white toner 1 | carrier 2 | 5 | 0.70 | 45 |
| white developer 3 | white toner 1 | carrier 3 | 10 | 1.10 | 40 |
| white developer 4 | white toner 1 | carrier 4 | 15 | 2.00 | 35 |

TABLE 2-continued

| | the kind of toner | the kind of carrier | Aw amount of conductive fine particle relative to 100 parts by mass of resin (parts by mass) | Iw dynamic current value 100 V (μA) | toner charged amount (μC/g) |
|---|---|---|---|---|---|
| white developer 5 | white toner 2 | carrier 1 | 0 | 0.23 | 50 |
| white developer 6 | white toner 1 | carrier 6 | 0 | 0.25 | 49 |

TABLE 3

| | the kind of toner | the kind of carrier | Ac amount of conductive fine particle relative to 100 parts by mass of resin (parts by mass) | Ic dynamic current value 100 V (μA) | toner charged amount (μC/g) |
|---|---|---|---|---|---|
| cyan developer 1 | cyan toner 1 | carrier 1 | 0 | 0.23 | 70 |
| cyan developer 2 | cyan toner 1 | carrier 2 | 5 | 0.70 | 56 |
| cyan developer 3 | cyan toner 1 | carrier 3 | 10 | 1.10 | 53 |
| cyan developer 4 | cyan toner 1 | carrier 4 | 15 | 2.00 | 48 |
| cyan developer 5 | cyan toner 1 | carrier 5 | 20 | 3.00 | 42 |
| cyan developer 6 | cyan toner 2 | carrier 3 | 10 | 1.10 | 53 |
| cyan developer 7 | cyan toner 1 | carrier 7 | 10 | 1.30 | 51 |
| cyan developer 8 | cyan toner 1 | carrier 8 | 0 | 1.20 | 52 |

Example 1

The cyan developer 2 and the white developer 1 were input into a Y positon and an M position of a digital multi-function printer "BIZHUB PRO (registered trademark) C6500" (manufactured by Konica Minolta Business Technologies Co., Ltd), respectively. Transfer unevenness was evaluated by forming an image of a 5 cm×5 cm square obtained by stacking a cyan toner image on a white toner image using a transparent OHP sheet was formed. In order to form ae image, first, an evaluation machine was stopped while an image was developed on an image holder, an amount of the developed toner on the image holder was measured, and an adhesion amount was adjusted to be 5 g/m$^2$. At this time, it was confirmed that no unevenness due to developing occurred. The evaluation was performed in the NN environment (temperature: 20° C., relative humidity: 50% RH). The 10th image and the 10000th image were evaluated regarding the same image.

When the evaluation was performed, black paper was prepared, and an obtained image was superimposed thereon. Occurrence of unevenness due to transfer of the white developer and the cyan developer was thereby confirmed visually based on the following standard. It was judged that "a" to "c" were acceptable.

a: No unevenness occurred and there is no practical problem.

b: Unevenness occurred partially but there is no practical problem.

c: Unevenness occurred but there is no practical problem.

d: Unevenness occurred and there is a practical problem.

Examples 2 to 10 and Comparative Examples 1 to 4

Transfer unevenness was evaluated in a similar manner to Example 1 except that the white developers and the cyan developers indicated in the following Table 4 were used.

Evaluation results are indicated in the following Table 4.

TABLE 4

| | white developer | | | | cyan developer | | | | | transfer uneveness | |
|---|---|---|---|---|---|---|---|---|---|---|---|
| | the kind | Aw (parts by mass) | Iw (μA) | charged amount (μC/g) | the kind | Ac (parts by mass) | Ic (μA) | charged amount (μC/g) | Iw/Ic | 10th | 10000th |
| Example 1 | white developer 1 | 0 | 0.23 | 50 | cyan developer 2 | 5 | 0.70 | 56 | 0.33 | b | b |
| Example 2 | white developer 1 | 0 | 0.23 | 50 | cyan developer 3 | 10 | 1.10 | 53 | 0.21 | a | a |
| Example 3 | white developer 1 | 0 | 0.23 | 50 | cyan developer 4 | 15 | 2.00 | 48 | 0.12 | a | a |
| Example 4 | white developer 1 | 0 | 0.23 | 50 | cyan developer 5 | 20 | 3.00 | 42 | 0.08 | b | b |
| Example 5 | white developer 2 | 5 | 0.70 | 45 | cyan developer 3 | 10 | 1.10 | 53 | 0.64 | b | b |
| Example 6 | white developer 3 | 10 | 1.10 | 40 | cyan developer 4 | 15 | 2.00 | 48 | 0.55 | b | c |
| Example 7 | white developer 4 | 15 | 2.00 | 35 | cyan developer 5 | 20 | 3.00 | 42 | 0.67 | b | c |
| Example 8 | white developer 5 | 0 | 0.23 | 45 | cyan developer 6 | 10 | 1.10 | 48 | 0.21 | a | b |
| Example 9 | white developer 6 | 0 | 0.25 | 49 | cyan developer 7 | 10 | 1.30 | 51 | 0.19 | a | c |
| Example 10 | white developer 1 | 0 | 0.23 | 50 | cyan developer 8 | 0 | 1.20 | 52 | 0.19 | a | c |
| Comparative Example 1 | white developer 1 | 0 | 0.23 | 50 | cyan developer 1 | 0 | 0.23 | 70 | 1.00 | d | d |
| Comparative Example 2 | white developer 2 | 5 | 0.70 | 45 | cyan developer 1 | 0 | 0.23 | 70 | 3.04 | d | d |
| Comparative Example 3 | white developer 3 | 10 | 1.10 | 40 | cyan developer 2 | 5 | 0.70 | 56 | 1.57 | d | d |
| Comparative Example 4 | white developer 4 | 15 | 2.00 | 35 | cyan developer 3 | 10 | 1.10 | 53 | 1.82 | d | d |

As clear from the above Table 4, it has been found that transfer unevenness is reduced in the image forming method in Examples.

What is claimed is:

1. An image forming method of forming a color toner image and a white toner image using an image forming apparatus having a plurality of developing machines, wherein the color toner image is formed using a color developer comprising at least one color toner selected from the group consisting of a yellow toner, a magenta toner, and a cyan toner and a first carrier, the white toner rilage is formed using a white developer comprising a white toner containing at least titanium oxide as a pigment and a second carrier, and the following formula (1) is satisfied wherein Ic (μA) is a dynamic current value of the first carrier at 100 V and Iw (μA) is a dynamic current value of the second carrier at 100 V, $$Iw<Ic \quad (1).$$

2. The image forming method according to claim 1, wherein the Iw (μA) satisfies the following formula (2):

$$0.1\mu A<Iw<2.0\mu A \quad (2).$$

3. The image forming method according to claim 1, wherein a ratio (Iw/Ic) between the Iw (μA) and the Ic (μA) satisfies the following formula (3):

$$0.10<Iw/Ic<0.25 \quad (3).$$

4. The image forming method according to claim 1, wherein the first carrier and the second carrier each have a resin coating layer comprising a coating resin and a conductive fine particle on a surface of a core particle, a chemical bond in a repeating unit of the coating resin of the first carrier is contained commonly in a repeating unit of the coating resin of the second carrier, a main element of the conductive fine p-rticie of the first carrier is the same as that of the conductive fine particle of the second carrier, and the main element is an element of which the content is more than 50% by atom wherein a total amount of atoms contained in each conductive fine particle is 100% by atom, and the following formula (4) is satisfied wherein Ae (parts by mass) is a content of the conductive fine particle relative to 100 parts by mass of the coating resin in the resin coating layer of the first carrier and Aw (parts by mass) is a content of the conductive fine particle relative to 100 parts by mass of the coating resin in the resin coating layer of the second carrier, $$0\leq Aw<Ac \quad (4).$$

5. The image forming method according to claim 4, wherein the AN (parts by mass) is less than 10 parts by mass.

6. The image forming method according to claim 4, wherein the coating resin of the first carrier and the coating resin of the second carrier each comprise a constitutional unit derived from an alicyclic (meth)acrylic ester compound.

7. The image forming method according to claim 1, wherein the color toner and the white toner each comprise a crystalline polyester resin as a binder resin.

8. The image forming method according to claim 7, wherein the crystalline polyester resin. is a hybrid crystalline polyester resin in which a crystalline polyester resin unit and an amorphous resin unit other than a polyester resin are chemically bonded.

9. An electrostatic charge image developer set comprising:

a color developer comprising at least one color toner selected from the group consisting of a yellow toner, a magenta toner, and a cyan toner and a first carrier; and a white developer comprising a white toner comprising at least titanium oxide as a pigment and a second carrjer, wherein the following formula (1) is satisfied wherein Ic (μA) is a dynamic current value of the first carrier at 100 V and Iw (μA) is a dynamic current value of the second carrier at 100 V, $$Iw<Ic \quad (1).$$

10. An image forming apparatus comprising the electrostatic charge image developer set according to claim 9 and a plurality of developing machines.

* * * * *